US005223197A

United States Patent [19]

Boles et al.

[11] Patent Number: 5,223,197

[45] Date of Patent: Jun. 29, 1993

[54] PROCESS OF MAKING MIXED FILAMENT YARN

[75] Inventors: Raymond L. Boles, Hixson, Tenn.; Benjamin H. Knox, Wilmington, Del.; James B. Noe, Wilmington, N.C.

[73] Assignee: E. I. Du Pont de Nemours and Company, Wilmington, Del.

[21] Appl. No.: 786,584

[22] Filed: Nov. 1, 1991

Related U.S. Application Data

[63] Continuation-in-part of Ser. No. 338,251, Apr. 14, 1989, Pat. No. 5,066,447, which is a continuation-in-part of Ser. No. 53,309, May 22, 1987, abandoned, and a continuation-in-part of Ser. No. 824,363, Jan. 30, 1986, abandoned, which is a continuation-in-part of Ser. No. 541,692, Jun. 21, 1990, abandoned.

[51] Int. Cl.[5] ..... D02H 7/00; D02J 1/22

[52] U.S. Cl. ..... 264/103; 28/172.2; 28/190; 264/210.8; 264/211.12; 264/235.6; 264/290.5

[58] Field of Search ..... 264/103, 210.8, 211.12, 264/235.6, 290.5, 290.7; 28/172.2, 190

[56] References Cited

U.S. PATENT DOCUMENTS 4,025,595 5/1977 Mirhej ..... 264/103

FOREIGN PATENT DOCUMENTS 144617 6/1985 European Pat. Off. .

OTHER PUBLICATIONS

Translation of French reference 2,404,066 (published Apr. 20, 1979).

*Primary Examiner*—Leo B. Tentoni

[57] ABSTRACT

A process of making mixed filament yarns, involving drawing, especially cold-drawing, or hot-drawing, or other heat-treatments, of spin-oriented crystalline polyester filaments, and particularly polyester feed yarns, that have been prepared by spinning at speeds of, e.g., 4 km/min, and have low shrinkage and no natural draw ratio in the conventional sense, that provides useful technique for obtaining uniform filaments of desired denier and thereby provides improved flexibility to obtain filaments and yarns mixed with nylon filaments.

16 Claims, 18 Drawing Sheets

YARN NO. VI-1

YARN NO. VI-2

YARN NO VII-2

YARN NO VIII-3

YARN NO IX-2

YARN NO. VII-2

YARN NO. IX-2

PROCESS OF MAKING MIXED FILAMENT YARN

CROSS-REFERENCE TO RELATED APPLICATIONS

This is a continuation-in-part of application Ser. No. 07/338,251, filed by Knox and Noe Apr. 14, 1989, which has issued as U.S. Pat. No. 5,066,447, and which is sometimes referred to herein as the parent application, but which is also itself a continuation-in-part application of application Ser. No. 07/053,309, filed May 22, i987, as a continuation-in-part of application Ser. No. 824,363, filed Jan. 30, 1986, and a continuation-in-part also of pending application Ser. No. 07/541,692, filed by Boles et al Jun. 21, 1990 , now abandoned.

TECHNICAL FIELD

This invention concerns improvements in and relating to continuous filaments, especially in the form of multifilament yarns, and more especially to a capability to provide from the same feed stock polyester continuous filaments of various differing deniers, as desired, such as can be co-drawn and/or co-mingled with nylon filaments to provide mixed yarns of nylon filaments and polyester filaments, and of other useful properties, including improved processes; new yarns, resulting from such processes; and downstream products from such filaments and yarns.

BACKGROUND OF PARENT APPLICATION

Textile designers are very creative. This is necessary because of seasonal factors and because the public taste continually changes, so the industry continually demands new products. Many designers in this industry would like the ability to custom-make their own yarns, so their products would be more unique, and so as to provide more flexibility in designing textiles.

Polyester (continuous) filament yarns have for many years had several desirable properties and have been available in large quantities at reasonable cost, but, hitherto, there has been an important limiting factor in the usefulness of most polyester flat yarns to textile designers, because only a limited range of yarns has been available from fiber producers, and the ability of any designer to custom-make his own particular polyester flat yarns has been severely limited in practice. The fiber producer has generally supplied only a rather limited range of polyester yarns because it would be more costly to make a more varied range, e.g. of deniers per filament (dpf), and to stock an inventory of such different yarns.

Also, conventional polyester filaments have combinations of properties that, for certain end-uses, could desirably be improved, as will be indicated hereinafter. It is important to recognize that what is important for any particular end-use is the combination of all the properties of the specific yarn (or fiber), sometimes in the yarn itself during processing, but also in the eventual fabric or garment of which it is a component. It is easy, for instance, to reduce shrinkage by a processing treatment, but this modification is generally accompanied by other changes, so it is the combination or balance of properties of any filament (or staple fiber) that is important. Generally, hereinafter, we refer to flat (i.e., untextured) filament yarns. It will be recognized that, where appropriate, the technology may apply also to polyester filaments in other forms, such as tows, which may then be converted into staple fiber, and used as such in accordance with the balance of properties that is desirable and may be achieved as taught hereinafter, but the advantage and need that the invention satisfies is more particularly in relation to flat filament yarns (i.e. untextured continuous filament yarns), as will be evident.

For textile purposes, a yarn must have certain properties, such as sufficiently high modulus and yield point, and sufficiently low shrinkage, which distinguish these yarns from feeder yarns that require further processing before they have the minimum properties for processing into textiles and subsequent use. These feeder yarns are sometimes referred to as feed yarns, which is how we refer to them herein, for the most part. Conventionally, flat polyester filament yarns used to be prepared by melt-spinning at low speeds (to make undrawn yarn that is sometimes referred to as LOY) and then drawing and heating to reduce shrinkage and to increase modulus and yield point.

It has long been known that such undrawn (LOY) polyester filaments draw by a necking operation, as disclosed by Marshall and Thompson in J. Applied Chem., 4, (April 1954), pp. 145–153. This means that the undrawn polyester filaments have a natural draw ratio. Drawing such polyester filaments has not been generally desirable (or practiced commercially) at draw ratios less than this natural draw ratio because the result has been partial-drawing (i.e., drawing that leaves a residual elongation of more than about 30% in the drawn yarns) that has produced irregular "thick-thin" filaments which have been considered inferior for most practical commercial purposes (unless a specialty yarn has been required, to give a novelty effect, or special effect). For filament yarns, the need for uniformity is particularly important, more so than for staple fiber. Fabrics from flat (i.e. untextured) yarns show even minor differences in uniformity from partial drawing of conventional undrawn polyester yarns as defects, especially when dyeing these fabrics. Thus, uniformity in flat filament yarns is extremely important. The effect of changing the draw ratio within the partial-draw-range of draw ratios (below the natural draw ratio) has previously had the effect of changing the proportions of lengths of drawn and undrawn filament in previous products. Thus, hitherto it has not been possible to obtain from the same LOY feed yarn two satisfactory different uniform yarns whose deniers per filament (dpfs) have varied from each other's by as much as 10%, because one of such yarns would have been non-uniform (or filaments would have broken to an unacceptable extent).

Undrawn polyester filaments have been unique in this respect because nylon filaments and polypropylene filaments have not had this defect. Thus, it has been possible to take several samples of a nylon undrawn yarn, all of which have the same denier per filament, and draw them, using different draw ratios, to obtain correspondingly different deniers in the drawn yarns, as desired, without some being irregular thick-thin yarns, like partially drawn polyester filaments. This is pertinent to a relatively new process referred to variously as "warp-drawing", "draw-warping" or "draw-beaming", as will be evident herein.

For many textile processes, such as weaving and warp knitting, it has been customary to provide textile yarns in the form of warp yarns carefully wound on a large cylinder referred to as a beam. A beaming operation has always involved careful registration and winding onto the beam of warp yarns provided from a large creel. Formerly, the warp yarns on the creel used to be drawn yarns, already suitable for use in textile processes, such as weaving and knitting.

Recently, there has been interest in using flat undrawn filament yarns, which have generally been cheaper than drawn yarns, and incorporating a drawing step in the beaming operation, as disclosed, e.g., by Seaborn, U.S. Pat. No. 4,407,767. This process is referred to herein as "draw-warping", but is sometimes called draw-beaming or warp-drawing. At least three commercial draw-warping machines have been offered commercially. Barmag/Liba have cooperated and built a unit, which is described and illustrated in Chemiefasern/Textilindustrie, February 1985, page 108 and pp. E14–15. There are also articles in Textile Month, March 1985, page 17, and in Textile World, May 1985, page 53. Karl Mayer/Dienes sell commercial draw-beaming systems, as advertised, e.g., on page 113 of the same February 1985 issue of Chemiefasern/Textilindustrie. The concept was discussed by Frank Hunter in Fiber World, September 1984, pages 61–68, in an article entitled "New Systems for Draw-Beaming POY Yarns", with reference to the Liba/Barmag and Karl Mayer systems using polyester POY and nylon. The Karl Mayer system was also described by F. Maag in Textile Month, May 1984, pages 48–50. Karl Mayer also have patents, e.g., DE 3,018,373 and 3,328,449. Cora/Val Lesina have also been selling draw-warping systems for some time, and have patents pending. These commercial machines are offered for use with polyester, polyamide or polypropylene yarns, the drawing systems varying slightly according to the individual yarns. As indicated, the object is to provide beams of drawn warp yarns, that are essentially similar to prior art beams of warp yarns, but from undrawn feed yarns. The advantages claimed for draw-warping are set out, e.g., in the article by Barmag/Liba, and have so far been summarized as better economics and better product quality.

As indicated, draw-warping had been suggested and used for polyester yarns. The article by Barmag/Liba indicates that POY, MOY or LOY yarn packages can be used to cut the raw material costs. POY stands for partially oriented yarn, meaning spin-oriented yarn spun at speeds of, e.g., 3–4 km/min for use as feeder yarns for draw-texturing. Huge quantities of such feeder yarns have been used for this purpose over the past decade, as suggested in Petrille, U.S. Pat. No. 3,771,307 and Piazza & Reese, U.S. Pat. No. 3,772,872. These draw-texturing feeder yarns (DTFY) had not been used, e.g., as textile yarns, because of their high shrinkage and low yield point, which is often measurable as a low T7 (tenacity at 7% elongation) or a low modulus (M). In other words, POY used as DTFY is not "hard yarn" that can be used as such in textile processes, but are feeder yarns that are drawn and heated to increase their yield point and reduce their shrinkage. MOY means medium oriented yarns, and are prepared by spinning at somewhat lower speeds than POY, e.g., 2–2.5 km/min, and are even less "hard", i.e., they are even less suitable for use as textile yarns without drawing. LOY means low oriented yarns, and are prepared at much lower spinning speeds of the order of 1 km/min or much less.

As has already been explained above and by Marshall and Thompson, conventional undrawn LOY polyester has a natural draw ratio. Attempts at "partial drawing" at lower draw ratios (such as leave a residual elongation of more than about 30% in the drawn yarns) will generally produce highly irregular "thick-thin" filaments, which are quite unsuitable for most practical commercial purposes. Among other important disadvantages, this severely limits the utility of LOY polyester as a practical draw-warping feed yarn. When undrawn polyester draw-texturing feed yarns of high shrinkage are prepared at higher spinning speeds, there is still generally a natural draw ratio at which these yarns prefer to be drawn, i.e., below which the resulting yarns are irregular; although the resulting irregularity becomes less noticeable, e.g., to the naked eye or by photography, as the spinning speed of the precursor feed yarns is increased, the along-end denier variations of the partial drawn yarns are nevertheless greater than are commercially desirable, especially as the resulting fabrics or yarns are generally dyed. Yarn uniformity is often referred to in terms of % Uster, or can be expressed as Denier Spread, as will be discussed hereinafter. It is not merely a question of denier uniformity, although this may be a convenient check on whether a yarn is uniform, as partially-drawn denier variations often mean the filaments have not been uniformly oriented along-end, and variations in orientation affect dye-uniformity. Dyeing uniformity is very sensitive to variations resulting from partial drawing. So, even for polyester POY prepared at relatively high spinning speeds, as will be seen hereinafter in the Example, partial drawing of such POY has produced yarn that is unacceptable, e.g., from a dyeing uniformity standpoint. Thus, hitherto, even with POY, such as has been used as feed yarn for draw-texturing (often referred to as DTFY herein), it has not been practical to draw-warp the same such POY (DTFY) to two different dpfs that vary from each other by as much as 10% and obtain two satisfactory uniform drawn yarns without significant broken filaments, because one would have been partially drawn.

Thus, it will be understood that a serious commercial practical defect of prior suggestions for draw-warping most prior undrawn polyester (POY, MOY or LOY) had been the lack of flexibility in that it had not been possible to obtain satisfactory uniform products using draw ratios below the natural draw ratio for the polyester feed yarn. This was different from the situation with nylon POY or polypropylene.

So far as is known, it had not previously been suggested that a draw-warping process be applied to a polyester textile yarn, i.e., one that was itself already a direct-use yarn, such as had shrinkage properties that made it suitable for direct use in textile processes such as weaving and knitting without first drawing. Indeed, to many skilled practitioners, it might have seemed a contradiction in terms to subject such a yarn to draw-warping because such a yarn was already a textile yarn, not a feed yarn that needed a drawing operation to impart properties useful in textile processes such as weaving or knitting.

According to the parent application (Serial No. 07/338,251 referred to hereinabove, the disclosure of which is hereby incorporated herein by reference), processes were provided for improving the properties of feed yarns of undrawn polyester filaments Such processes involved drawing with or without heat during the drawing and with or without post heat-treatment, and are most conveniently adapted for operation using a draw-warping machine, some such being sometimes referred to as draw-beaming or warp-drawing operations.

Preferred undrawn polyester feed yarns comprise spin-oriented polyester filaments of low shrinkage, such as have been disclosed in Knox U.S. Pat. No. 4,156,071. Alternatively, spin-oriented feed yarns of low shrinkage may be prepared at speeds higher than are used in the Knox patent, including speeds and conditions such as are disclosed by Frankfort & Knox in U.S. Pat. Nos. 4,134,882 and 4,195,051.

The parent application was primarily concerned with the preparation of and improvement of undrawn polyester yarns and filaments, as indicated. The present invention is concerned primarily with the preparation and processing of mixed filament yarns, comprised of filaments of nylon as well as filaments of polyester.

As indicated hereinbefore, nylon filament yarns, such as nylon 66 and nylon 6 partially-oriented yarns (PON), have been capable of being uniformly fully or partially drawn. This drawing can be carried out hot or cold, with or without any post heat treatment. In contrast, conventional spin-oriented polyester POY, as described for example by Piazza and Reese (U.S. Pat. No. 3,772,872), is not capable of being uniformly cold or partially drawn. Such conventional polyester POY is only capable of being drawn uniformly when hot drawn, and fully drawn to elongations less than about 30%. Otherwise, such polyester POY is not drawn uniformly, so gives along-end "thick-thin" denier variability that has been characteristic of drawing to elongations greater than about 30%, as reported, for instance, by Bosley, et al. U.S. Pat. No. 4,026,098; Lipscomb, et al. U.S. Pat. No. 4,147,749; Nakagawa, et al. U.S. Pat. No. 4,084,622; Allen, et al. U.S. Pat. No. 3,363,295. It has also been reported that such prior art drawing results in along-end spontaneous crimp on shrinkage (Schippers U.S. Pat. No. 4,019,311; col. 10/lines 44–59 and col. 11/lines 24–31). Both of these are undesirable defects for end-uses requiring uniform along-end dyeability.

According to the invention, in contrast to such prior suggestions, an improvement in the commercial drawing of undrawn polyester filaments is provided such as to permit the drawing of spin-oriented polyester filaments essentially "as if they were spin-oriented nylon filaments"; that is, the spin-oriented polyester filaments of low shrinkage according to the invention "may be treated as spin-oriented nylon filaments in their drawing behavior". So this invention permits the uniform co-drawing of spin-oriented polyester and nylon filaments over a wide range of draw ratios and temperatures.

SUMMARY OF INVENTION

According to the present invention, there are provided the following processes:

A process for preparing a mixed filament textile yarn comprised of drawn polyester and nylon filaments, characterized in that spin-oriented polyester filaments and nylon feed filaments are partially drawn to uniform filaments by hot-drawing or by cold-drawing, with or without heat setting, and the polyester and nylon filaments are combined to form a mixed filament yarn before or after said drawing and/or heat setting treatments; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about ($250\rho$–282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

A process for preparing a mixed filament textile yarn comprised of drawn polyester and nylon filaments, characterized in that spin-oriented polyester filaments and nylon feed filaments are cold drawn to uniform filaments with or without heat setting, and the polyester and nylon filaments are combined to form a mixed filament yarn before or after said drawing and/or heat setting treatments; wherein said spin-oriented polyester filaments are characterized by an intrinsic viscosity [$\eta$]about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about ($250\rho$–282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

A process for preparing a mixed filament textile yarn comprised of drawn polyester and nylon filaments, characterized in that spin-oriented polyester filaments and nylon feed filaments are drawn to uniform filaments by hot-drawing without heat setting, and the polyester and nylon filaments are combined to form a mixed filament yarn before or after said drawing; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about ($250\rho$–282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

A process for preparing a mixed filament textile yarn comprised of drawn polyester and nylon filaments, characterized in that spin-oriented polyester filaments and nylon feed filaments are drawn to uniform filaments by hot-drawing with post heat treatment to reduce shrinkage, at such a draw ratio to provide said uniform filaments with elongation-to-break at least about 30%, and the polyester and nylon filaments are combined to form a mixed filament yarn before or after said drawing and/or post heat treatments; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_2$) less than about 8% maximum shrinkage tension (ST) less than about 0.3 gpd., density ($\rho$) about 1.35 to about 1.39 g/cm$^3$, and crystal size (CS) about 55 to about 90 Angstroms and also at least about (250$\rho$-282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about I0%, and dimensional stability as measured by a ($\Delta L_{135\text{-}40\ C}$)-value less than 0.

A process for preparing a mixed filament textile yarn comprised of polyester and nylon filaments, characterized in that spin-oriented polyester filaments and nylon feed filaments are heat treated without drawing, and the polyester and nylon filaments are combined to form a mixed filament yarn before or after said heat treatment; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$-282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

A process for preparing a post-bulkable mixed filament yarn, wherein spin-oriented polyester filaments and nylon feed filaments are drawn to uniform drawn filaments by hot-drawing or by cold-drawing, and then said drawn filaments are post treated at temperatures ($T_R$), selected to preferentially reduce the shrinkage of the drawn polyester filaments such that boil-off shrinkages ($S_1$) of the resulting drawn polyester filaments and drawn nylon filaments differ from each other by at least about 5%; and the polyester and nylon filaments are combined to form a mixed filament yarn before or after said drawing and/or heat treatment; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about 250$\rho$-282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

A mixed filament yarn, suitable for use as a textile yarn, comprised of spin-oriented polyester filaments and of nylon filaments, wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$-282.5) Angstroms; and wherein said nylon filaments are characterized by relative viscosity (RV) about 40 to about 80, elongation-to- break ($E_B$) about 60 to about 90%, boil-off shrinkage ($S_1$) less than about 10%, and dimensional stability as measured by a ($\Delta L_{135\text{-}40\ C}$)-value less than 0.

A mixed filament textile yarn, comprised of drawn polyester filaments and of drawn nylon filaments of elongation ($E_B$) between about 20 and about 90% and boil-off shrinkage ($S_1$) less than about 10%, and wherein said drawn polyester filaments are of intrinsic viscosity [$\eta$] about 0.56 to about 0.68, tenacity at 7% elongation ($T_7$) at least about 1 gram/denier, post yield modulus (PYM, g/d) such that its square root ($\sqrt{PYM}$) is about 2.5 to about 5, thermal stability as shown by an $S_2$-value less than about +2%, net shrinkage ($S_{12}$) less than about 8%, maximum shrinkage tension (ST) less than about 0.5 g/d, density ($\rho$) about 1.355 to about I.415 grams/cubic centimeter, and of crystal size (CS) about 60 to about 90 Angstroms and also at least about the following value in the relation to density: CS>(250$\rho$-282.5), Angstroms; and wherein said drawn nylon filaments are of relative viscosity (RV) about 40 to about 80, and a dimensional stability as given by a ($\Delta L_{135\text{-}40\ C}$)-value less than 0.

A process for preparing a mixed filament yarn, of polyester filaments and nylon filaments, of elongation ($E_B$) about 60% to about 90% and boil-off shrinkage ($S_1$) less than about 10%, comprising co-spinning, attenuating, quenching, and winding said polyester and nylon filaments at a withdrawal speed of about 3.5 km/min to about 6.5 km/min, such that the relative viscosity (RV) of said nylon filaments is between about 40 and 80 and less than about the expression: [13.3(km/min)−(6.5−X)], wherein X is the weight percent of any copolyamide, with suitable dimensional stability, as measured by a ($\Delta L_{135\text{-}45\ C}$)-value less than about 0; and wherein said polyester filments are of intrinsic viscosity [$\eta$] about 0.56 to about 0.68, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$-282.5) Angstroms. Such a process lends itself to coupled spin/draw preparation of mixed filament yarns, e.g. as follows.

A process that is a coupled spin/draw process wherein, prior to winding, such co-spun polyester filaments and nylon filaments are partially drawn to provide uniform drawn polyester and drawn nylon filaments, by hot-drawing or by cold-drawing to drawn elongations ($E_B$) between about 30% and about 90% and wherein these drawn elongations ($E_B$) differ from each other by less than about 5%, with or without heat setting to provide a boil-off shrinkage less than about 10% and drawn nylon filaments of dimensional stability as given by a ($\Delta L_{135\text{-}40\ C}$)-value less than 0; and wherein said drawn polyester filaments are of tenacity at 7% elongation ($T_7$) at least about 1 gram/denier, post yield modulus (PYM, g/d) such that its square root ($\sqrt{PYM}$) is about 2.5 to about 5, thermal stability as shown by an $S_2$-value less than about +2%, net shrinkage ($S_{12}$) less than about 8%, maximum shrinkage tension (ST) less than about 0.5 g/d, density ($\rho$) about 1.355 to about 1.415 grams/cubic centimeter, and of crystal size (CS)

about 60 to about 90 Angstroms and also at least about (250ρ−282.5) Angstroms.

A process that is a coupled spin/draw process, wherein prior to winding, such co-spun polyester and nylon filaments are cold drawn to provide uniform drawn polyester and drawn nylon filaments, of drawn elongations ($E_B$) about 20% to about 90% and said drawn elongations ($E_B$) differ from each other by less than about 5%, with or without heat setting to provide boil-off shrinkage ($S_1$) less than about 10% and drawn nylon filaments of dimensional stability as given by a ($\Delta L_{135\text{-}40\ C}$)-value less than 0; and wherein said drawn polyester filaments are of tenacity at 7% elongation ($T_7$) at least about 1 gram/denier, post yield modulus (PYM, g/d) such that its square root (√PYM) is about 2.5 to about 5, thermal stability as shown by an $S_2$-value less than about +2%, net shrinkage ($S_{12}$) less than about 8%, maximum shrinkage tension (ST) less than about 0.5 g/d, density (ρ) about 1.355 to about 1.415 grams/cubic centimeter, and of crystal size (CS) about 60 to about 90 Angstroms and also at least about (250ρ−282.5) Angstroms.

In such processes wherein yarns are post heat treated to reduce shrinkage, such post heat treatments are preferably carried out at temperatures ($T_R$ in degrees C.) less than about the following expression:

$$T_R < (1000/[4.95-1.75(RDR)_{D,N}]-273),$$

where $(RDR)_{D,N}$ is the calculated residual draw ratio of the drawn nylon filaments, and is at least about 1.2 to provide for uniform dyeability of the nylon filaments with large molecule acid dyes.

These spin-oriented polyester and nylon filaments may be drawn in the form of weftless warp sheets which may then be further processed, e.g., by knitting or weaving, or may be wound onto a beam. The filaments may be combined in the form of mixed filament yarns or the filaments need not be combined and may be drawn as separate yarn bundles, as to provide for drawing of a weftless pattern warp.

As indicated, the spin-oriented polyester feed yarn filaments are characterized by an intrinsic viscosity [η] about 0.56 to about 0.68 (preferably about 0.62 to about 0.68), elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density (ρ) about 1.35 to about 1.39 g/cm$^3$, and crystal size (CS) about 55 to about 90 Angstroms and also at least about (250ρ−282.5) Angstroms. The nylon feed yarn filaments are characterized by relative viscosity (RV) about 40 to about 80 (preferably about 50 to about 70), elongation-to-break ($E_B$) about 60 to about 90%, boil-off shrinkage ($S_1$) less than about 10%, and dimensional stability as measured by a ($\Delta L_{135\text{-}40\ C}$)-value less than 0. The polyester and nylon polymers of said filaments may contain minor amounts of copolyesters and copolyamides, respectively, preferably about 2 to 10% by weight, and may contain minor amounts of chainbranching agents, preferably about 0.02 and 0.2 mole %; wherein said copolymers are added to increase dyeability, shrinkage, and to a lesser extent, elongation; and wherein said chainbranching agents are added to increase elongation, dyeability, and for polyesters, to decrease shrinkage. Increasing polymer viscosity decreases elongation and shrinkage of the polyester filaments. For the nylon filaments, however, increasing polymer viscosity increases elongation, and has only minor effects on shrinkage. The filament denier and shape are generally selected primarily to meet the aesthetic and functional needs of the intended end-use; it is also known that decreasing filament denier, or increasing the surface-to-volume ratio via use of odd cross-sections, reduces the elongation and increases the shrinkage of the spin-oriented polyester filaments, and have only minor effects on the elongation and shrinkage of the spin-oriented nylon filaments.

The elongation-to-break (Eb) of the spin-oriented polyester filaments and nylon feed filaments are preferably very similar, any differences in the $E_B$ values amounting desirably to less than about 5%. Especially desirable spin-oriented polyester and nylon feed filaments are in the form of mixed filament co-spun feed yarns.

Such spin-oriented polyester filaments, used herein, may advantageously be treated with caustic applied to freshly-extruded filaments, as described by Grindstaff and Reese (allowed Application, Serial No. 07/420,459) to provide the polyester filaments with improved moisture-wicking properties, more akin to those of the nylon filaments.

Mixed filament textured yarns may be provided by air-jet texturing the resulting mixed filament drawn yarns.

Alternatively mixed filament false-twist textured yarns may be provided of elongation ($E_B$) between about 20 and about 60% and boil-off shrinkage ($S_1$) less than about 10%, comprised of uniform drawn polyester filaments and of uniform drawn nylon filaments, wherein said drawn polyester filaments are of intrinsic viscosity [η] about 0.56 to about 0.68, tenacity at 7% elongation ($T_7$) at least about 1 gram/denier, post yield modulus (PYM, g/d) such that its square root (√PYM) is about 2.5 to about 5, thermal stability as shown by an $S_2$-value less than about +2%, net shrinkage ($S_{12}$) less than about 8%, maximum shrinkage tension (ST) less than about 0.5 g/d, density (ρ) about 1.355 to about 1.415 grams/cubic centimeter, and of crystal size (CS) about 60 to about 90 Angstroms and also at least about the following value in the relation to density: CS>(250ρ−282.5), Angstroms; and wherein said drawn nylon filaments are of relative viscosity (RV) about 40 to about 80, and a dimensional stability as given by a ($\Delta L_{135\text{-}40\ C}$)-value less than 0.

These may be provided by a process characterized in that spin-oriented polyester filaments and nylon feed filaments are simultaneously partially drawn and false-twist textured to uniform filaments by hot-drawing with or without heat setting, and the polyester and nylon filaments are combined to form a mixed filament yarn before or after said drawing and/or heat setting treatments; wherein said spin-oriented polyester filaments are characterized by an intrinsic viscosity [η] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density (ρ) about 1.35 to about 1.39 g/cm$^3$, and crystal size (CS) about 55 to about 90 Angstroms and also at least about (250ρ−282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40}$ $c$)-value less than 0.

If desired, however, a process may be provided characterized in that spin-oriented polyester filaments and nylon feed filaments are sequentially partially drawn to uniform filaments by hot-drawing or by cold-drawing, then false-twist texutred with heat setting, and the polyester and nylon filaments are combined to form a mixed filament yarn before or after said drawing and/or texturing treatments; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$–282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40}$ $c$)-value less than 0.

The polyester and/or nylon filaments may be modified, if desired, with about 1 to about 3 mole percent of ethylene-5-sodium-sulfo isophthalate to impart cationic dyeability with cationic dyestuffs. Representative copolyesters used to enhance dyeability with disperse dyes are mentioned in Most U.S. Pat. No. 4,444,710, Pacofsky U.S. Pat. No. 3,748,844, Hancock U.S. Pat. No. 4,639,347, and Frankfort and Knox U.S. Pat. Nos. 4,134,882 and 4,195,051, and representative chain-branching agents used to reduce shrinkage, especially of polyesters modified with ionic dye sites and/or copolyesters, are mentioned in Knox U.S. Pat. No. 4,156,071 , MacLean U.S. Pat. No. 4,092,229, and Reese U.S. Pat. Nos. 4,883,032; 4,996,740; and 5,034,174. To obtain low shrinkage spin-oriented feed yarns with modified polyesters, it is advantageous to increase polymer viscosity by up to about 0.01[$\eta$] units and/or add minor amounts of chain-branching agents (e.g., about 0.1 mole percent)z.

Resulting drawn polyester and nylon filaments of codrawn polyester/nylon yarns according to the present invention are characterized, in addition to polymer type and viscosity as described above, by residual elongations between about 20 and 90%, preferably between about 20 and 60%, boil-off shrinkages ($S_1$) less than about 10%, atmospheric dyeability, with advantages in that these drawn polyester filaments may be dyed to deep shades under the same dyebath conditions as used to dye the nylon filaments, as indicated, by having a Relative Disperse Dye Rate (RDDR), described hereinbefore, greater than about 0.075, preferably greater than 0.09, as indicated by having a value of the square-root of the post-yield modulus ($\sqrt{PYM}$) about 2.5 to 5 $\sqrt{gpd}$ and preferably a RDDR-value at least about [0.165–0.025 $\sqrt{PYM}$].

Such drawn polyester filaments are preferably of intrinsic viscosity [$\eta$] about 0.62 to about 0.68 and such drawn nylon filaments are preferably of relative viscosity (RV) about 50 to about 70. Such drawn polyester and nylon filaments may preferably also be of denier less than about 1.

As will be understood, feed filaments may be supplied and/or processed according to the inventiion in the form of a yarn or as a bundle of filaments that does not necessarily have the coherency of a true "yarn", but for convenience herein a plurality of filaments may often be referred to as a yarn or bundle, without intending specific limitation by such term.

DETAILED DESCRIPTION

Figure 1:
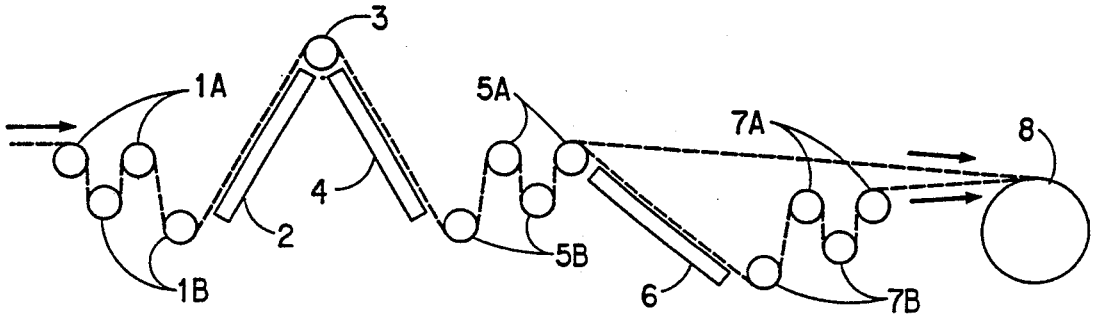
FIG. 1 shows schematically a typical commercial draw-warping machine that may be used to practice a preferred process of the invention.

By taking advantage of similarities in the drawing behavior of existing undrawn nylon filaments and in the (surprising) characteristics of the undrawn polyester feed filaments according to the invention, it is now possible for the first time to provide a practical process for the making of uniformly drawn mixed polyester/nylon filament yarns by the drawing of a feed yarn of undrawn mixed polyester/nylon filaments. This (mixed filament) feed yarn may be formed by: (i) the co-mingling of undrawn nylon filaments and of undrawn polyester filaments, (selected according to the criteria described herein) such as by co-feeding separate or precomingled undrawn polyester and nylon filament yarns into the draw zone, for example, of a single-end draw machine, of a draw air-jet texturing process, or of a draw-warping process; and preferably by: (ii) co-extruding, such polyester and nylon filaments from the same or from separate spin packs, wherein the freshly extruded nylon filaments (especially) are protected from oxidative degradation, preferably by use of steam blanketing of the face of the spinneret, attenuating and quenching such freshly extruded polyester and nylon filaments, and co-mingling said polyester and nylon filaments, especially after converging and applying finish to these filaments by use of a ceramic tip metered finish applicator guide (such as described by Agers U.S. Pat. No. 4,926,661), wherein the length of convergence, $L_c$, is adjusted preferably over a distance within the range 50 to 150 cm, to achieve optimum along end uniformity, to form a single filament bundle using an inert gaseous interlace jet (such as described by Bunting and Nelson U.S. Pat. No. 2,985,995 and by Gray U.S. Pat. No. 3,563,029) and winding the resulting co-mingled polyester/nylon filament yarn from packages for co-drawing generally in separate downstream textile processes (such as, draw air-jet texturing, draw false-twist texturing, single-end drawing for fill yarns, draw-warping of weftless warp sheets wound onto beams); or (iii), if desired, by coupling the co-spinning and co-drawing process steps into a coupled spin/draw process, wherein, after drawing, the retractive forces of the spun/drawn filaments are decreased, if required, to suitable levels for winding into packages by overfeeding between rolls, and/or application of mild heat conditions, such as passing over heated rolls or through a steam jet, the coupled spin/drawn polyester/nylon filament yarn being wound up into packages suitable for direct-use without further drawing and/or heat treatments; or such coupled spin/drawn direct-use yarns may be used as feed yarns for downstream textile processing, wherein the primary draw-ratio ($DR_1$), taken in the coupled spin/draw step, and the secondary draw ratio ($DR_2$), taken in a separate split process, are selected such that their product ($DR_{12}$) [in other words $DR_1 \times DR_2$] is less than about the maximum draw ratio ($DR_{MAX}$) . This draw ratio ($DR_{MAX}$) is obtained by dividing $(RDR)_L$ by 1.2, $(RDR)_L$ being the residual draw-ratio of the component having the lowest elongation-to-break $(E_B)_L$, and being defined by the relationship $(RDR)_L=[1+(E_B)_L/100]$. For example, if the (RDR)-values for the undrawn polyester and nylon filaments are, respectively, 1.9 and 1.75, and the selected primary draw ratio ($DR_1$) is 1.3, then partially co-drawn polyester and nylon filaments are provided with drawn $(RDR)_D$-values of 1.46 (i.e. 1.9/1.3) and 1.346 (i.e. 1.75/1.3), respectively. The partial co-drawn yarn may then be used "as-is" or may be drawn again in a separate step with a maximum secondary draw-ratio $(DR_2)_{MAX}$ of 1.122 [i.e. 1.346/1.2], where $(DR_2)_{MAX}$ is calculated by taking the $(RDR)_D$-value of the component having the lowest spin/drawn RDR-value (in this example, the spun/drawn nylon filaments with a $(RDR)_D$-value of 1.346) and dividing this $(RDR)_D$-value by 1.2, being a minimum $(RDR)_D$-value, selected to avoid filament breakage that would result from overdrawing to RDR-values less than about 1.2. The mixed yarns of this invention may, if desired, be co-drawn to $(RDR)_D$-values less than 1.20, while recognizing that this will increase the tendency for the filaments to break, and at some level this will become unacceptable for commercial use. In the above processes (designated by (i), (ii) and (iii), the level and type of spin finish and interlace are selected based on the particular end-use processing needs (e.g., inter-filament friction, mixing, and configuration).

Most of the disclosure from the parent application is included hereinafter, for convenience, because the variations may be applicable also to various processes according to the present invention.

DESCRIPTION OF PARENT INVENTION

Many of the polyester parameters and measurements mentioned herein are fully discussed and described in the aforesaid Knox patent in the and Frankfort & Knox patents, all of which are hereby specifically incorporated herein by reference, so further detailed discussion herein would, therefore, be redundant. Such parameters include the tensile, shrinkage, orientation (birefringence), crystallinity (density and crystal size), viscosity and dye-related measurements, except in so far as mentioned and/or modified hereinafter.

Preferred polyester feed yarn filaments are undrawn in the sense disclosed by Knox, Frankfort & Knox, Petrille and Piazza & Reese. Sometimes such filaments are referred to as spin-oriented, because the orientation (and crystallization eventually derived therefrom) is caused by high-speed spinning, as opposed to the older process of first spinning at low speeds, of the order 0.5 (or as much as 1) km/min, to make LOY, followed by drawing and annealing which older process produces a completely different crystal fine structure in such conventional drawn yarns, in contrast to the combination of lower orientation and larger crystals derived from high-speed spinning (spin-orientation). This combination provides many advantages, such as improved dyeability and shrinkage properties, as disclosed by Knox and by Frankfort & Knox.

A low shrinkage is an essential requirement for textile yarns, as discussed by Knox; in fact, the shrinkage behavior of conventional drawn polyester yarns has not been as good as for other yarns, e.g., cellulose acetate, and this has caused textile manufacturers to use correspondingly different techniques for polyester fabric construction and finishing. At relatively high spinning speeds, e.g., as described by Frankfort & Knox, of the order of 5 km/min and higher, it is difficult to obtain uniform filaments without the desired low shrinkage under preferred spinning conditions. However, at speeds of the order of 4 km/min, as disclosed by Knox, special spinning conditions are necessary to prepare the preferred feed yarns of low shrinkage and having the other requirements of uniformity and tensile properties. In contrast, POY has lower crystallinity and significantly higher shrinkage such as is desired for use as feeder yarns for draw-texturing, this having been a very much larger end-use than direct-use untextured polyester filament yarn. It becomes increasingly difficult to obtain extremely low shrinkage values in undrawn polyester yarns directly by high speed spinning, and so the preferred feed yarns will, in practice, rarely have $S_1$ below about 2%, although this may be desirable.

The shrinkage and shrinkage tension measurements were as measured in U.S. Pat. No. 4,156,071, except that the loads were 5 mg/denier for 30 minutes when measuring $S_1$ (boil-off shrinkage), and for 3 minutes at 350° F. (177° C.) for $S_2$ and DHS, to simulate trade heat-set conditions. The thermal stability ($S_2$) is a measure of the additional change in length on exposure to dry heat (350° F.) after initial boil-off shrinkage ($S_1$). The feed yarns of this invention have $S_2$ values of less than about +1%, i.e., the yarns do not shrink significantly during the test. Under the test conditions, some yarns may elongate, in which case the $S_2$ value is given in a parenthesis. The feed yarns generally do not elongate more than about 3%. The drawn yarns of this invention have $S_2$ values of less than about +2% (i.e, shrink less than about 2%) and generally do not elongate greater than about 3%. The net shrinkage is the sum of $S_1$ and $S_2$, accordingly, is designated $S_{12}$; although this has not often been referred to in the literature, it is a very important value, in some respects, for the fabric manufacturer, since a high and/or non-uniform net shrinkage ($S_{12}$) means an important loss in effective fabric dimensions, as sold to the eventual consumer. Uniformity of shrinkage is also not often referred to, but is often very important in practice in fabric formation. The drawn filaments of the present invention show an important advantage over conventional polyester in this respect.

The combination of low shrinkage values ($S_1$, $S_2$ and $S_{12}$) of the feed yarns used in the process of the invention (hereinafter the feed yarns) distinguishes such feed yarns from conventional POY, which as DTFY, i.e. as a feeder yarn for draw-texturing, preferably has low crystallinity and so higher shrinkage, and from conventional drawn yarns. Preferably the feed yarns have both $S_1$ and $S_{12}$ values less than about 6%.

As indicated hereinbefore, it is very surprising that the feed yarns can be fully or partially cold-drawn uniformly, in other words to provide drawn yarns/filaments of uniform denier (along-end), in contrast to the less satisfactory results of cold-drawing conventional undrawn polyester filaments. The ability to fully or partially draw by cold-drawing polyester filaments according to the present invention to provide uniformly drawn filaments is an important advantage, since this makes it possible to improve tensiles without a drastic reduction in dyeability or increase in shrinkage, and thus provide yarns, filaments and tows with an improved combination of tensiles, dyeability and shrinkage. This cold-drawing does increase the low shrinkage values of the feed yarns, and there is some reduction in the easy dyeability, these being such notable advantages of the feed yarns (in contrast to conventional polyester), and this is a good example of the need to consider the total combination (or balance) of properties of any polyester filaments or yarns, rather than a single property in isolation. However, even this combination of increased shrinkage and reduced dyeability of the resulting drawn yarns is still generally significantly improved over conventional drawn polyester, because of the different crystal fine structure that results from spin-orientation, and consequent crystallization. The low shrinkage values, especially $S_{12}$, distinguish the drawn products, i.e., filaments, yarns and tows (and staple therefrom) of the invention from conventional drawn polyester. Preferably, these drawn products have both $S_{1\ l\ and\ S12}$ values less than about 6%.

In some end-uses, a low shrinkage tension is very important because less tension is generated during yarn processing, and later, in fabrics, less puckering occurs, in contrast to drawn yarns. A preferred value for both feed yarns and drawn products is less than 0.15 grams/denier.

Figure 2:
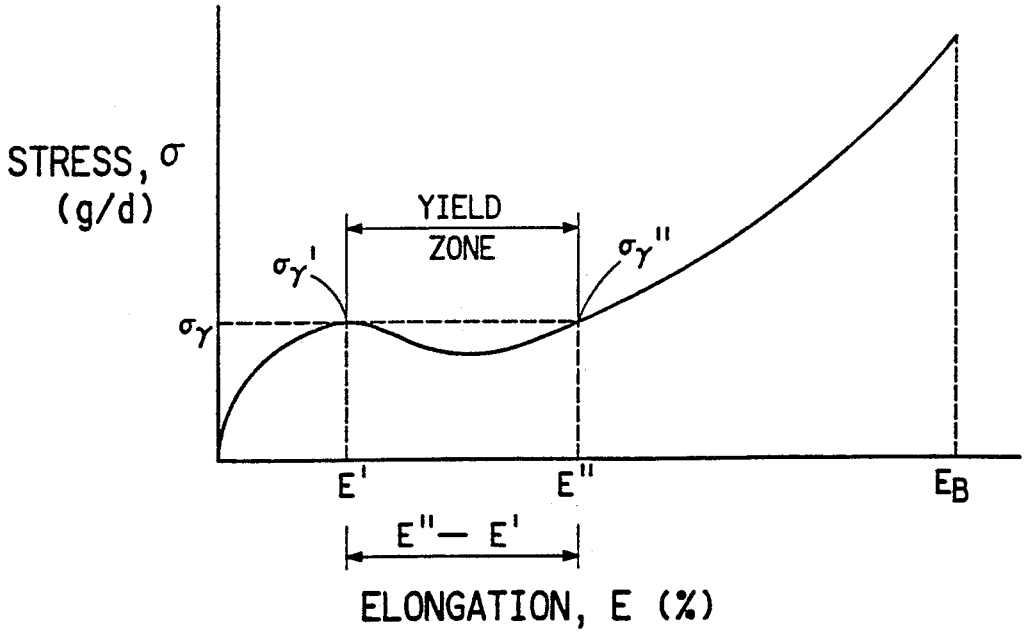
FIGS. 2–6 are graphs.
Figure 3:
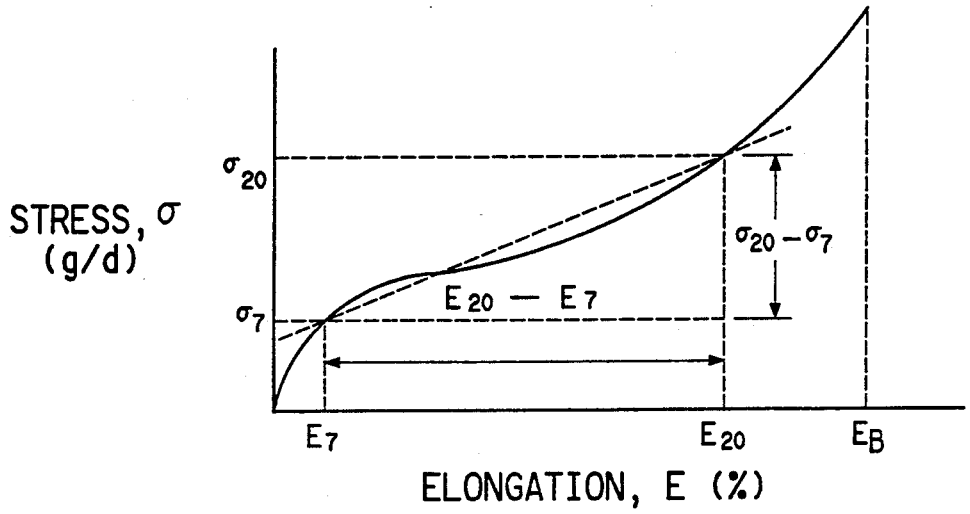

Of the tensile measurements, only the post yield modulus (PYM) requires explanation and definition, as follows, and as illustrated with reference to FIGS. 2 and 3, which are both graphs plotting stress ($\sigma$) against elongation (E) for a preferred feed yarn, FIG. 2, and a resulting drawn yarn, FIG. 3. The stress ($\sigma$) at any elongation (E) which is measured as a percentage of the original length) is given in grams/denier by:

$$\text{Stress } (\sigma) = 0.01(100+E) \times (\text{Load/initial denier}).$$

Thus the stress is calculated in terms of the denier at the time of measurement (which denier changes during elongation) whereas the tenacity is usually recorded in terms of the initial denier only. If a yarn has a yield zone, as shown in FIG. 2, this will be clear on a plot of stress v. E. The yield zone (E''-E') is the range of elongation for which the stress first decreases and then increases below $\sigma_y$, i.e., when the yarn yields because the stress decreases below peak value $\sigma_y$ as E increases beyond E' (when $\sigma$ passes through peak value $\sigma'_y$) until the stress again regains peak value $\sigma''_y$ at E'' (the post-yield point). As indicated hereinbefore, preferred feed yarns were described by Knox, and have advantages in some end-uses (somewhat like cellulose acetate) partly because of their relatively low modulus. This advantage in aesthetics is however accompanied by a relatively low yield point (shown by a relatively large yield zone) which can be a disadvantage if it is desirable to use such yarns as filling, because the sudden increases in stress imposed by many weaving techniques may stretch such yarns irreversibly and only intermittently, with a resulting defect that can be revealed when the woven fabric is later dyed.

It is surprising that the feed yarns which, according the invention, show a distinct yield zone, E''-E'>0, in the plot of Stress v. E, so that there is a natural draw ratio in this sense looking at the plot, but such feed yarns do not perform as if there is a natural draw ratio when drawn at lower draw ratios, since such preferred feed yarns draw uniformly at such low draw ratios, in contrast to conventional POY spun at similar speeds but of higher shrinkage.

The post yield modulus is defined herein as the slope of the plot of stress v. elongation between $E_7$ and $E_{20}$, i.e., elongations of 7 and 20%, and is given by the relationship:

$$PYM = \frac{\sigma_{20} - \sigma_7}{E_{20} - E_7}$$

However, since generally one records load/initial denier, rather than stress, PYM is always calculated herein according to the following equivalent relationship:

$$PYM = \frac{1.2\ T_{20} - 1.07\ T_7}{0.13}$$

The $\sqrt{PYM}$ after boil-off (ABO) should be in the approximate range 2.5 to 5, preferably 3 to 5, corresponding to absence of any yield zone.

Reverting to the feed yarns, the minimum value of $T_7$ (0.7 g/d) and the range of $E_B$ (40–120%) coupled with large crystals, are important characteristics of spin-oriented yarns that provide the ability to be drawn uniformly as indicated above, in contrast with conventional POY and other undrawn yarns of higher shrinkage which are not capable of consistent drawing at low draw ratios to provide filaments of equivalent uniformity. Such combination of parameters approximates to a yield zone of less than 15%. Preferably the $T_7$ is at least 0.8 g/d, and the $E_B$ is less than 90%, corresponding to a yield zone of less than 10%. In practice, $T_7$ is not usually greater than 1.7 g/d for feed yarns, and more usually less than about 1.2 g/d. Drawing increases the $T_7$, the preferred minimum of $T_7$ is about 1 g/d, with $E_B$ about 20–90%, and preferably about 20–60%, which provides sufficient initial tensiles for textile processability, even for weaving. Thus, by drawing, especially by cold-drawing, it is possible to improve the tensiles (and textile processability) of preferred feed yarns so that they can sustain sudden stresses such as are encountered for filling yarns in weaving processes, without impairing the uniformity, or losing all the advantages of improved dyeability and better shrinkage properties than conventional drawn polyester yarn. Preferred tenacity (T), and modulus (M), values in g/d, respectively, are at least 2.5, and in the range 40–100 for the drawn yarns, which provide useful textile properties with a wider range of fabric textile aesthetics than available with conventional drawn polyester. These drawn yarns are "hard yarns" with essentially no yield zone, unlike preferred precursor feed yarns, as shown by the range of $\sqrt{PYM}$ (ABO) mentioned above.

Although the process of the invention is not limited to cold-drawing, the importance of the ability for the first time to carry out cold-drawing (fully and partially drawing) of undrawn polyester yarns should be emphasized, because of the improvement in uniformity that results. External heaters are an inevitable source of variability, and therefore non-uniformity, end-to-end, as well as along-end. The latter improvement also improves tensile properties and uniformity of shrinkage. Use of heaters also leads to "stop-marks" in the resulting fabrics, which can be avoided by cold-drawing. Uniformity is also affected by any lack of uniformity in the feed yarns, e.g., non-uniform interlace.

The tensiles are measured in the Example and shown in Tables I-III first on yarns AW, then ABO and also ADH, meaning, respectively, "As Warped", "After Boil-Off" and "After Dry Heat", to distinguish the state of the yarns at different stages of textile processing, it being understood that some of the values were measured on yarn taken from tubes, e.g., for comparison yarns, while others were taken from beams.

The importance of large crystals has already been mentioned hereinabove, and by Knox and Frankfort & Knox, and their presence is shown by the density and crystal size, which should be as already mentioned. These parameters distinguish the feed yarns and the resulting drawn products from all conventional drawn yarns, from conventional POY and from spin-oriented yarns spun at low speeds, as described in those patents. Preferably, the drawn products are of density about 1.37 to about 1.415 g/cm$^3$.

Figure 4:
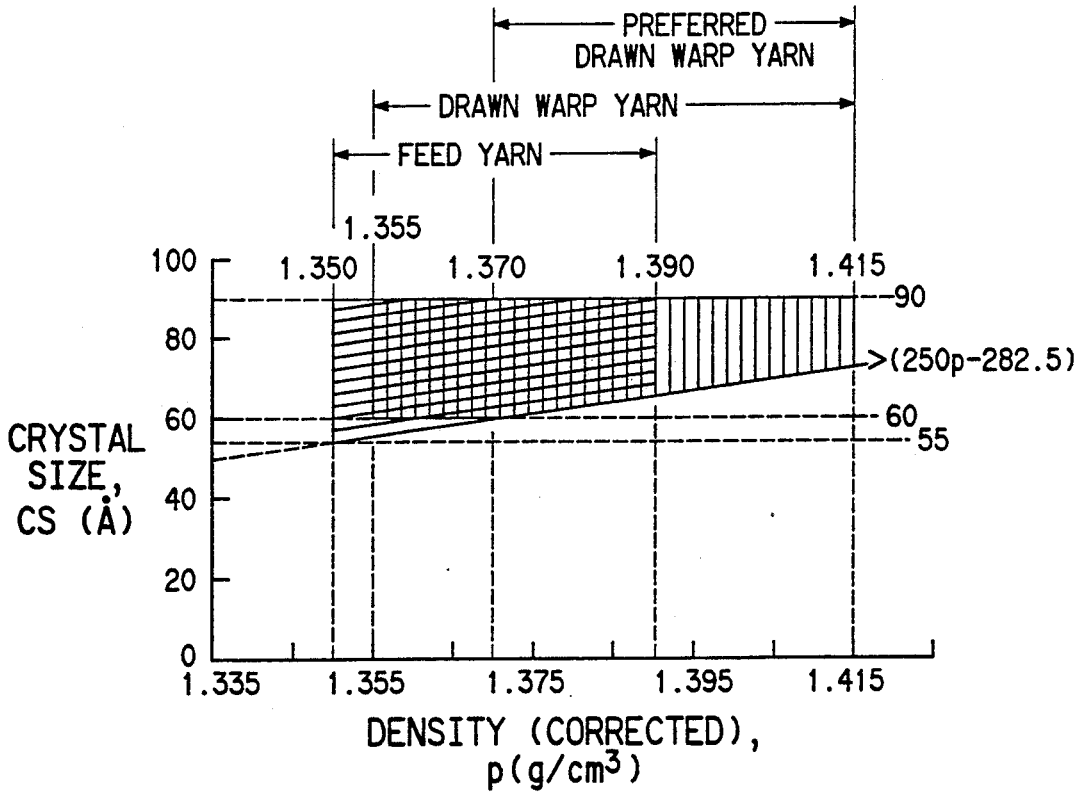
Figure 5:
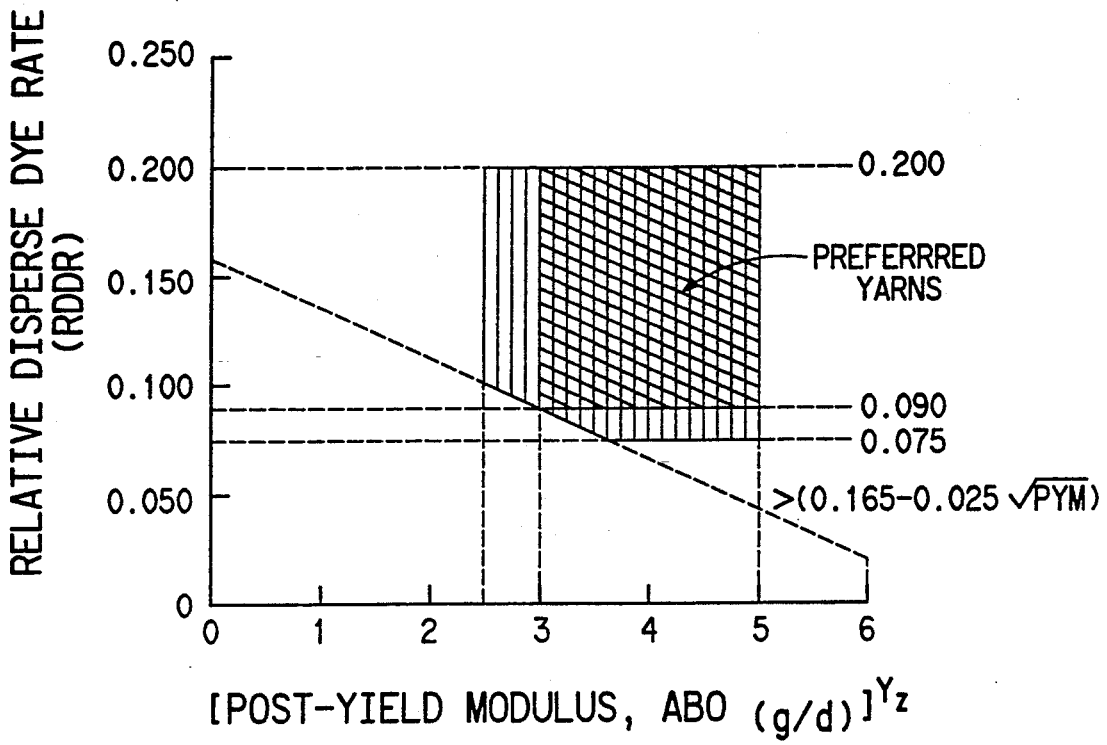

The relationship between crystal size (CS) and density ($\rho$) is illustrated in FIG. 4, for both feed yarns and drawn yarns, whereas in FIG. 5, the relationship between RDDR and $\sqrt{PYM}$ is illustrated.

The Relative Disperse Dye Rate, as defined and described by Knox, is significantly better than for conventional drawn polyester, and is preferably at least 0.09, for the drawn products, despite the fact that they have been drawn. The combination of this good dyeability (reduced from the corresponding feed yarns to an extent that depends on the drawing conditions and any heat setting) with tensile properties that are improved, especially the absence of any yield zone, as shown by the range of post yield modulus indicated above, distinguishes the novel drawn products from the prior art.

The K/S Dye Uptake values herein in Tables I, II and III were measured (as described by Frankfort & Knox, except that a McBeth spectrophotometer was used) on fabrics dyed with 4% on weight of fabric (OWF) of Teranil Yellow 2GW in a bath buffered to a pH of 5.5, boiled for 25 minutes, whereas the fabrics for Table IV were dyed with 4% OWF of Blue GLF at 95° C. for 60 minutes.

The Jersey Warp Knit fabrics were dyed in a minijet, with 1.5% OWF Eastman Polyester Blue GLF at a pH buffered to 5.0–5.5 for 40 minutes under pressure at 260° F. so as to favor the fabrics that do not have easy dye-at-boil characteristics (Tables II/III). If the fabrics had been dyed at the boil, those in Table I would have been well and uniformly dyed, whereas those in Table II/III would not have dyed very well and would have been even less uniform than shown in Table II/III. Δ Wt/Area % is a measure of area fabric shrinkage during this dyeing and subsequent heatsetting (dry at 300°–350° F. for 1 minute exposure with 5% overfeed).

The fabrics in Tables I, II and III were judged for dye uniformity and appearance as follows:

Fabric swatches (full width, i.e., approximately 20 inches wide and about 20–25 inches long) were laid on a large table covered with dull black plastic; the room lighting was diffuse fluorescent light. Four different attributes were judged:

(a) long streaks, i.e., those that persist throughout length of fabric sample and that are parallel to the selvedge;

(b) short, hashy streaks, i.e., those that do not persist throughout the length of the fabric sample;

(c) dye mottle, i.e., spotty pattern of light and dark regions, the spots being one or a few millimeters in diameter;

(d) deep dye streaks, i.e., intensely colored parts of the fabric, the color intensity being higher than the average of the fabric sample;

The rating scale is:

5 = no defect visible, absolutely uniform;

4 = minor unevenness observed, acceptable for almost all end uses;

3 = unevenness noticeable, not usable for high quality goods, may be used for utility apparel, second grade clothes;

2 = unevenness highly noticeable, too uneven for any apparel;

1 = extremely uneven, disastrously defective.

Each fabric sample was paired against each of the others and thus rated, such that the resulting ratings scaled the fabrics in this series. The fabrics and their ratings were given to laboratory colleagues for critique and found to be consistent and acceptable.

The Mullen Burst Test is a strength criterion for fabrics and was measured (lbs/in) according to ASTM 231-46. The Burst Strength is obtained by dividing the Mullen Burst by the Area Weight (oz/sq yd). Fabrics from drawn filament yarns according to the invention preferably have Burst Strengths (ABO) in the approximate range 15–35 (lbs/in)/(oz/sq yd) and also greater than about the value defined by the following relationship:

Burst Strength (ABO) $> 31[1-E_B(ABO)/100]$, where $E_B(ABO) \simeq 100[(E_B+S_1)/(100-S_1)]$, and where $S_1$ and $E_B$ are the boil-off shrinkage and elongation-to-break, respectively, as already mentioned. Burst strength (ABO) is preferably expressed in terms of $S_1$ and $E_B$ using the above expression for $E_B(ABO)$ to give the following relationship:

$$\text{Burst strength (ABO)} > 31[1-(E_B+S_1)/(100-S_1)].$$

Figure 6:
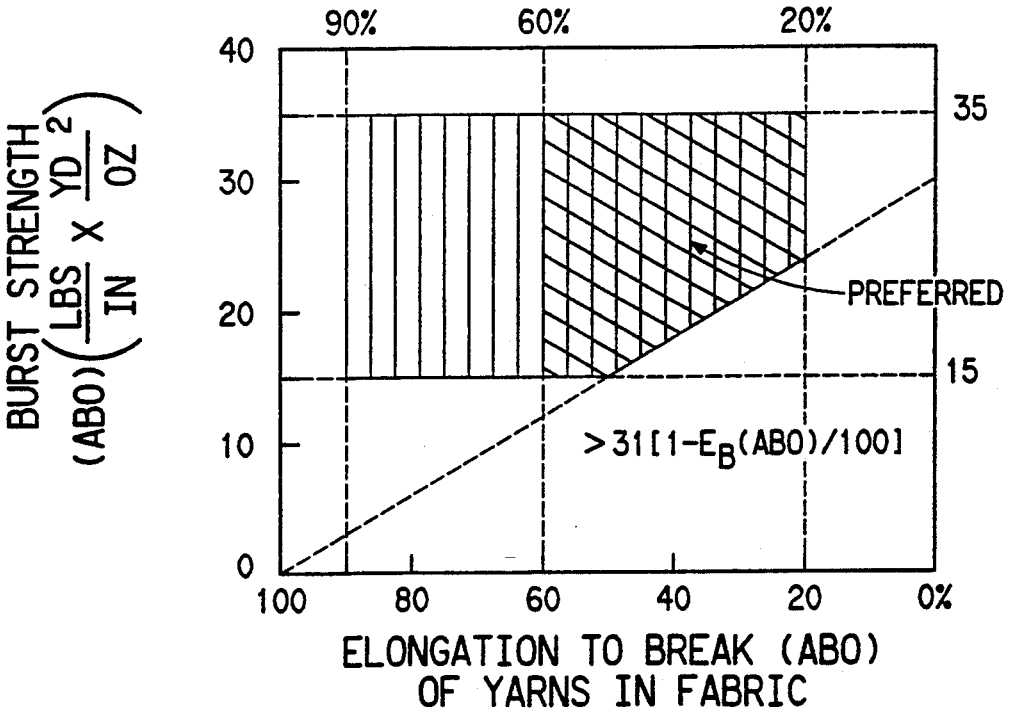

FIG. 6 illustrates the Burst Strength plotted against $E_B$ (ABO) for drawn yarns (AW) of $E_B$ about 20–90% and $S_1 < 10\%$, with preferred drawn yarns (AW) of $E_B$ about 20–60% and $S_1 < 6\%$.

The intrinsic viscosity [$\eta$] is generally in the approximate range 0.56–0.68 for textile yarns.

Preferred birefringence values for the feed yarns are in the approximate range 0.05–0.12, especially 0.05–0.09, and are correspondingly higher for the drawn products, namely 0.07–0.16. Birefringence values are very difficult to measure unless the yarns are of round cross section, and there is an increasing tendency for customers to prefer various non-round cross sections, because of their aesthetics.

Draw-warping may be carried out according to the directions of the manufacturers of the various commercial machines. The warp draw ratio (DR) will generally be given by:

$$DR \leqq \frac{100 + E_B}{100} \div (RDR)_D$$

where $E_B$ is the elongation of the feed yarns and $(RDR)_D$ is the residual draw ratio of the resulting warp-drawn yarns, and, using $E'_B$, the elongation of such warp-drawn yarns, instead of the feed yarns, may be given by:

$$(RDR)_D = \frac{100 + E_B'}{100}$$

This $(RDR)_D$ will generally be more than about 1.1X, and especially more than about 1.2X, i.e. to give corresponding $E'_B$ of more than 10%, and especially 20% or more, but this is largely a matter of customer preference.

Relative denier spread and Uster data as reported in Tables VII-XII are the ratios of the % coefficient of variations of results measured on warp-drawn yarns and corresponding feed yarns. The denier spread and Uster data are measured on a Model C-II Uster evenness tester, manufactured by Zwellweger-Uster Corporation. The denier spread data, which relate to long-term variations in yarn uniformity, are based on samples measured under the following conditions:

Yarn speed-200 meters/minute
Machine sensitivity-12.5 (inert setting)
Evaluation time-2.5 minutes
Chart speed-10 cm./minute Uster data, which relate to short-term variations in yarn uniformity, are measured at:

Yarn speed-25 meters/minute
Machine setting-normal
Evaluation time-1 minute
Chart speed-100 cm./minute Draw tension variation along the length of a continuous filament yarn is a measure of the along-end orientation uniformity and relates to dye uniformity. Yarns having a high draw tension variation give nonuniform, streaky dyed fabrics. Draw tension is measured with a Extensotron ® Model 4000 transducer equipped with a 1000 gram head which is calibrated at 200 grams, and the yarns are drawn at the RDR's specified while passing at an output speed of 25 meters/minute through a 100 cm. long tube heated to the temperature that is specified. The average draw tension is determined from 500 measurements, and the percent coefficient of variation is calculated and reported.

The parent invention lends itself to many variations, some of which are now described briefly:

1 (A) -Co-draw nylon POY (which can be cold drawn and partially drawn too) and the preferred feed yarns described herein, to provide a nylon/polyester mixed yarn warp.

(B) -Use heat-setting to reduce level of shrinkage and differential shrinkage of yarns if desired for any end-use.

2. Co-draw preferred feed yarns of different cross sections/deniers for a patterned warp, all at same shrinkage level. Use heat-setting to reduce level of shrinkage and differential shrinkage of yarns if desired for any end-use.

3. Co-draw split warp sheets, some cold and others with heat, to give a mixed shrinkage pattern warp.

4. Variable along-end heating would give varying shrinkage, and so give a patterned warp.

5. Use preferred feed yarns of different heat setting capability.

6. Use draw-warping to reduce denier and obtain unusually low denier warps.

7. Co-draw more than one beam, some of which have been alkali treated and then break the alkali-treated ends to give spun-like effect.

8. Hot draw in a bath containing dyestuffs, UV-screeners, or other additives to take advantage of high dye rate of the preferred feed yarns.

9. Cold draw with or without post-heat setting single ends of preferred feed yarns, for use as filling yarns. This could be performed on the loom itself.

10. Edge-crimp while cold-drawing preferred feed yarns. The resulting 8-10% shrinkage plus subsequent 1-2% elongation would give crimped yarns in fabric.

11. Use additives to increase light fastness of the preferred feed yarns.

From the foregoing, it will be clear that there are many ways to take advantage of the benefits of the preferred feed yarns in various drawing processes as described herein. The main advantages of these feed yarns over conventional POY can be summarized as:

1. Reduced sensitivity to heat means the eventual fabrics will be more uniform, and there is less potential for stop-marks.

2. By using the ability for cold-drawing, significantly improved uniformity can be obtained, with a useful combination/balance of tensile and shrinkage properties. This can be used to improve the tensiles (yield zone) with only slight loss of the improved dyeability of the feed yarn, so that it can be used, e.g., as a filling yarn for weaving, or for drawing and airjet texturing or for drawing and crimping for staple.

3. The process can involve less trimer production and fuming of the finish, which can lead to other advantages, for instance the feed yarn manufacturer can apply a finish that will persist and remain satisfactory beyond the draw-warping operation, i.e., reduce or avoid the need to apply further finish for weaving or knitting.

4. The resulting drawn products have generally higher rate of alkali weight reduction than conventionally drawn POY and fully drawn yarns.

5. The flexibility for the draw-warper to custom-tailor his desired combination of tensiles, shrinkage, dyeability and denier over a large range of draw-ratios while maintaining uniformity may be most prized advantage of many fabric designers.

6. The resulting drawn products have lower modulus than conventional drawn polyester, and so have generally better aesthetics.

7. Any type of draw-warping machine can be used, or even a tenter frame or slasher unit, for example, modified to incorporate warp beaming.

Indeed, further modifications will be apparent, especially as these and other technologies advance. For instance, any type of draw winding machine may be used. Also, as regards variation 9, for example, the yarns may have any end uses that have been or could be supplied by fully oriented yarns, including weft knitting yarns, and supply yarns for twisting and draw winding.

POLYESTER FILAMENT EXAMPLES

In the following Example, 6 separate draw-warping operations are carried out first according to the invention of the parent application. Table I shows for these operations (designated I-1 through I-6) yarn characteristics, warping conditions and fabric characteristics, and includes appropriate corresponding details for yarns that were not processed according to the invention (designated IA, IB and IC) so that their characteristics may be compared with yarns (I-1 through I-6) warp-drawn according to that invention.

Following Table I, details are given in Comparison Tables II and III for warp-drawing other control yarns, i.e. these warp-drawing processes were also for purposes of comparison only.

Following Tables II and III, another series of 8 draw-warping operations were carried out according to the invention of the parent application, with details given in Table IV, and designated as IV-2 through IV-9. IV-1 is merely the feed yarn used for these draw-warping operations.

Following Table IV, several important characteristics of the feed yarns used for draw-warping are compared side-by-side for convenience in Tables V and VI. V-3 was a feed yarn used to carry out the draw warping processes according to the invention of the parent application, as shown in Tables I and IV, whereas V-1 is the feed yarn used in Comparison Table II and V-2 is the feed yarn used in Comparison Table III. Similarly VI-3 was used according to that invention, whereas VI-1 and VI-2 were used for comparison experiments. The results are shown in the later Tables.

As disclosed in the Example and hereinbefore, the drawing can be carried out under various conditions. Cold-drawing is the term used when no external heat is applied; but, as is well known, exothermic heat of drawing and the friction of the running threadline will generally and inevitably heat any snubbing pin unless specific means are used to avoid or prevent this. Cold-drawing will generally somewhat raise the shrinkage of the resulting drawn yarn; this may be tolerable, depending on the balance of properties desired, and may be desirable for certain end-uses. Hot-drawing, where the feed yarn is heated, or when a cold-drawn yarn is annealed after drawing, will enable the operator to produce drawn yarns of low shrinkage, similar to that of the feed yarn; this will also reduce the dyeability somewhat, but the resulting dyeability will still be significantly higher than that of conventional drawn polyester.

The parameters of the test feed yarns in the Example were within the preferred ranges specified hereinabove. The draw-warping processes were carried out on an apparatus provided by Karl Mayer Textilmaschinenfabrik GmbH, D-6053 Obertshausen, Germany, illustrated schematically in FIG. 1, with reference to the Karl Mayer machine, (other commercial machines have also been used successfully and have arrangements that are somewhat similar or analogous). A sheet of warps is drawn by feed rolls 1A and 1B from a creel (not shown) on the left and is eventually wound on a beam 8 on the right of FIG. 1. Feed rolls 1A are heatable, if desired, whereas feed rolls 1B are non-heatable. The warp sheet then passes up in contact with an inclined plate 2, that may, if desired, be heated so as to preheat the warps, before passing over a heatable pin 3, sometimes referred to as a snubbing pin, and then down in contact with another inclined plate 4, which may, if desired, be heated so as to set the drawn warps before passing to the set of draw rolls 5A and 5B, that are driven at a greater speed than the feed rolls, so as to provide the desired warp draw ratio, and wherein draw rolls 5A may be heated if desired, whereas draw rolls 5B are non-heatable. The warps may, after leaving the draw rolls 5A and 5B, bypass directly to the beam winder 8, as shown in one option in FIG. 1, or may, if desired, undergo relaxing by passing down in contact with another inclined plate 6, which may be heated to relax the warps as they pass to a set of relax rolls 7A and 7B, that are driven at a speed appropriately less than that of the draw rolls, so as to provide the desired overfeed, and wherein relax rolls 5A may be heated, if desired, whereas relax rolls 5B are non-heatable, before passing to beam winder 8.

PARENT EXAMPLE

This first compares the results of six draw-warping processes according to the invention of the parent application (tests I-1 to I-6), using feed yarns of 108 denier, 50 filament (trilobal), that are spin-oriented with large crystals as described above, on the one hand, in contrast with two conventional drawn polyester yarns IA and IB and with a spun-oriented direct-use polyester yarn IC so to contrast the properties of these drawn yarns (tests I-1 through 6 and IA,B) and of the direct-use yarn IC and of fabrics made therefrom. Item IC is not a drawn yarn but a spun-oriented direct-use yarn that was also the feed yarn used to prepare yarns I-1 through I-6 (to show the effects of the draw-warping processes) and fabrics therefrom.

Tests 1 and 6 were essentially fully drawn to residual elongations of 25.4% and 30.7%, respectively, which correspond to residual draw ratios (RDR) of 1.254X and 1.307X, respectively. Yarns in Tests 2 through 5 were drawn at lesser draw ratios to residual elongations greater than 30%, corresponding to a residual draw ratio (RDR) greater than 1.3X. Yarns in Tests 4–6 were drawn cold (without externally-applied heat) wherein the heat of draw and friction increased the temperatures to about 70° C. All test yarns gave acceptable tensiles as indicated by an initial modulus (M) greater than 40 g/d, a tenacity at 7% elongation ($T_7$) of 1 g/d or greater and an elongation to break ($E_B$) less than 90% and especially less than 60%. The test yarns also maintained acceptable tensiles after boil-off shrinkage (ABO) and after dry heat shrinkage (ADH). The retention of tensiles after exposure to heat is attributed to a combination of densities ($\rho$) greater than about 1.355 g/cm$^3$ (and especially greater than about 1.37 g/cm$^3$) and very large crystals characterized by a wide-angle X-ray (WAXS) crystal size (CS) of at least 60 Angstrom and greater than about ($250\rho$–282.5) Angstrom. The thermal stability ($S_2$) is characterized by the additional change in yarn length on heating to 350° F. (177° C.) of less than about 2% (the (1.6) figure indicating an increase in length of 1.6% for I-4) after initial boil-off shrinkage ($S_1$) of less than about 10% and preferably less than about 6%, giving a net shrinkage ($S_{12}=S_1+S_2$) of less than about 8% and preferably less than about 6%.

In contrast, commercially available fully drawn hard yarns (IA and IB) have much inferior thermal stability ($S_2$) values of about 5% and net shrinkages ($S_{12}$) of about 12%, because they have smaller crystals of crystal size (CS) of 56 Angstrom and 44 Angstrom, respectively. The fully drawn hard yarns (IA and IB) also show about a 50% reduction in their initial tensiles (e.g., modulus, M, and tenacity at 7% elongation, $T_7$) after shrinkage (ABO) and (ADH).

The test yarns (I-1, 2, 3, 5 and 6) have similar thermal stability to the commercially available direct-use yarn (IC), but sustained tensiles, as characterized by a tenacity at 7% elongation ($T_7$) of greater than about 1 g/d and a post yield modulus (PYM) before and after boil-off of at least 5 g/d.

The test yarns (I-1 through 6) are further characterized by an improved dyeability as indicated by a Relative Disperse Dye Rate (RDDR) of at least 0.075 and preferably of at least 0.09 and greater than (0.165–0.025 $\sqrt{PYM, ABO}$). The test yarns have RDDR values 1.5X to 3X fully drawn hard yarns and depending on warp-draw process conditions, RDDR values nearly comparable to the commercially available direct-use yarn IC. Drawing the test yarns without added heat (i.e., cold, except for internal heat of draw) enhances dyeability, whereas external heat in general lowers dyeability.

The test yarns (I-i through 6) were knit into Jersey warp knit fabrics and dyed under commercial conditions—i.e., similar to those used for fabrics made with fully drawn hard yarns—but with a critical disperse dye (Blue GLF) to enhance non-uniformity. All test yarns give very uniform fabrics, comparable to commercially available fully drawn hard yarns (IA) and direct-use yarns (IC). This was unexpected since test yarns (I-2 through 5) were drawn to residual elongations greater than 30% and test yarns (I-4 through 6) were drawn cold.

The retention of uniformity is attributable to this unique and surprising capability of these test yarns to be partially drawn (hot or cold) to such residual elongations as are greater than 30%, and even greater than 40%, while maintaining uniform along-end denier and shrinkage properties. This unique capability of uniform drawing is believed to be due to a combination of an initial yield stress ($\sigma'_y$) of at least about 0.8 g/d and preferably 0.9 g/d which approximately corresponds to a tenacity at 7% ($T_7$) of at least about 0.7 g/d and preferably 0.8 g/d and a yield zone (E''- E') less than about 15% and preferably less than about 10% and a crystal structure characterized by large crystals of crystal size (CS) of at least 55 Angstrom and greater than about (250ρ–282.5) Angstrom for density (ρ) values 135–1.39 g/cm$^3$. The unique crystal structure is believed to permit the yarns to draw in a uniform manner, similar to nylon, without neck-drawing which would give rise to along-end denier and shrinkage non-uniformity.

The test yarn fabrics (I-1 through 6) also show improved thermal stability as characterized by ΔWt/area (%) values less than the commercially available fully drawn hard yarn (IA). The test yarn fabrics (I-1 through 6) also had acceptable Burst Strengths (ABO) of at least 15[(lbs.yd$^2$)/(oz.in)] and greater than about $31[1-(E_B+S_1)/(100-S_1)]$ where $E_B$ and $S_1$ are measured on the yarns (AW).

An important advantage when cold draw-warping was performed, was the absence of stop-marks on the resulting fabrics.

Although the draw-warping machine used in this Example was manufactured by Karl Mayer, the process has also been demonstrated with other machines, including draw-warping machines manufactured by Liba-Barmag and by Val Lesina, and slashers manufactured by Tsudakoma Corp.

The following abbreviations have been used in the Tables.

PY=Post Yield
RT=Room Temperature;
RND=Round;
TRI=Trilobal
ABO=After Boil-Off;
ADH=After Dry Heat;
AW=As Warped
OFF=Not heated; measured at approx. 70° C. due to heat of friction and draw
EWDR=WDR×[(100−% over feed)/100]
ΔWt./Area (%)=[1−Area Wt. (finished)/Area Wt.(greige)]100
Burst Strength=Mullen Burst/Area Wt. * (Corrected for $TiO_2$ pigment)

In Comparison Tables II and III, commercially available partially oriented yarns (POY) such as are used as feed yarns for draw-texturing were selected as control yarns for feeding to same draw-warping machine. Control yarn II is a nominal 115–34 trilobal POY With 0.035% $TiO_2$ and 0.658 intrinsic viscosity and is characterized in detail hereinafter as V-1 in Table V. Control feed yarn III is a nominal 107–34 round POY with 0.30% $TiO_2$ and of 0.656 intrinsic viscosity and is characterized in detail hereinafter as V-2 in Table V. Control feed yarn V-1 was draw-warped to a residual elongation of about 24% using temperatures similar to test I-1 and 2, except the set plate was at 160° C. The draw-warped yarn II-1 had poorer thermal stability than test yarns I-1 through 6, as characterized by an $S_2$ value >2% and a net shrinkage ($S_{12}$) greater than 8%. The dyeability of II-1 was significantly lower than the test yarns I-1 through 6 with an RDDR value of 0.062, or less than 0.075. The poorer dyeability is consistent with crystal size (CS) less than 60 Angstroms. Although the dyed Jersey warp knit fabrics had acceptable thermal stability and Burst Strength as indicated by Δwt/area of 29.4% and a Burst Strength of 26.6 (lbs.yd$^2$)/(oz.in), the dyed fabrics had poorer uniformity v. fabrics from test yarns (I-2 through 5), drawn to higher residual draw ratios.

The control feed yarn V-2 was draw-warped under identical conditions as the test yarn (V-3) except the draw ratio was increased because of the higher initial elongation-to-break ($E_B$) versus the test yarn. The control draw-warped yarns III-1 and 6 were fully drawn; III-2 to 5 were partially drawn; and III-4 through 6 were drawn without heat added. Control yarn III-5 was nearly fully drawn to a residual elongation of about 30% and then relaxed 10% to a final residual elongation-to-break of about 43%.

The dyeability of all the draw-warped POY (control yarns II and III) were poorer than that of the test yarns (I), except for III-4 which was drawn cold and had an excessive net shrinkage of 18.6%. The poorer dyeability of the control yarns II and III is consistent with smaller crystals of crystal size (CS) less than about (250ρ–282.5) Angstroms.

Figure 7:
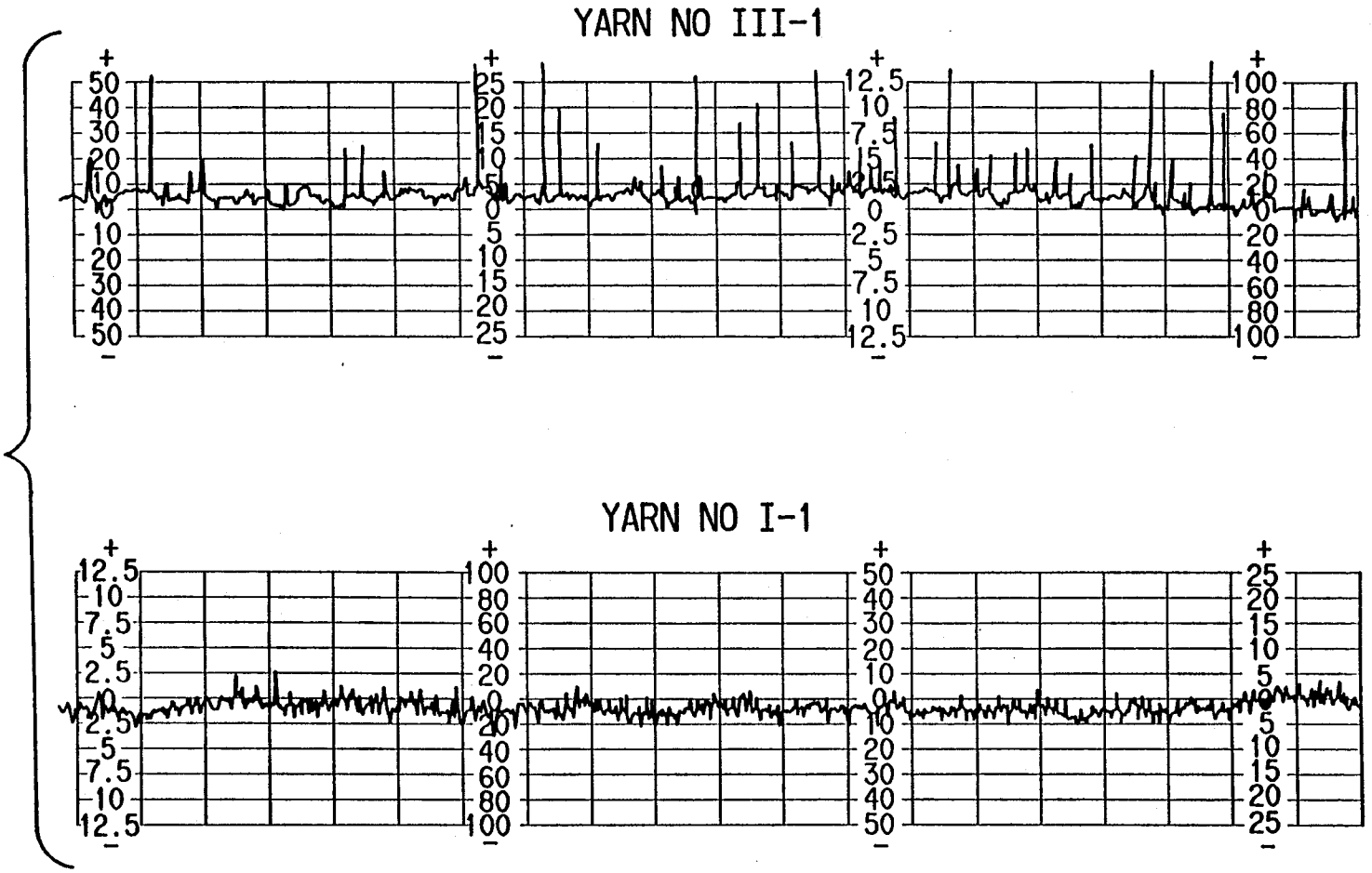
FIGS. 7–9 compare along-end denier Uster traces.
Figure 8:
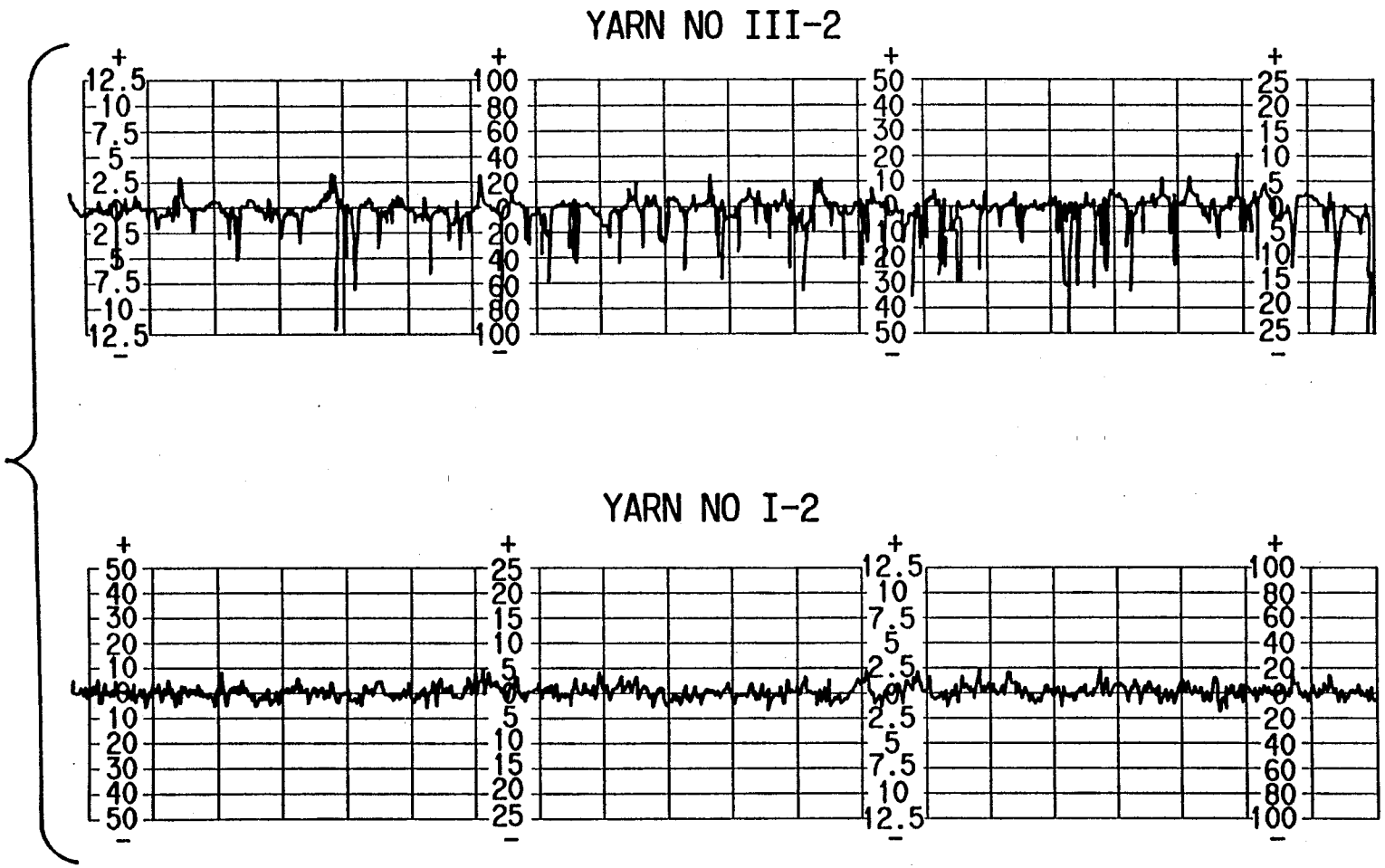
Figure 9:
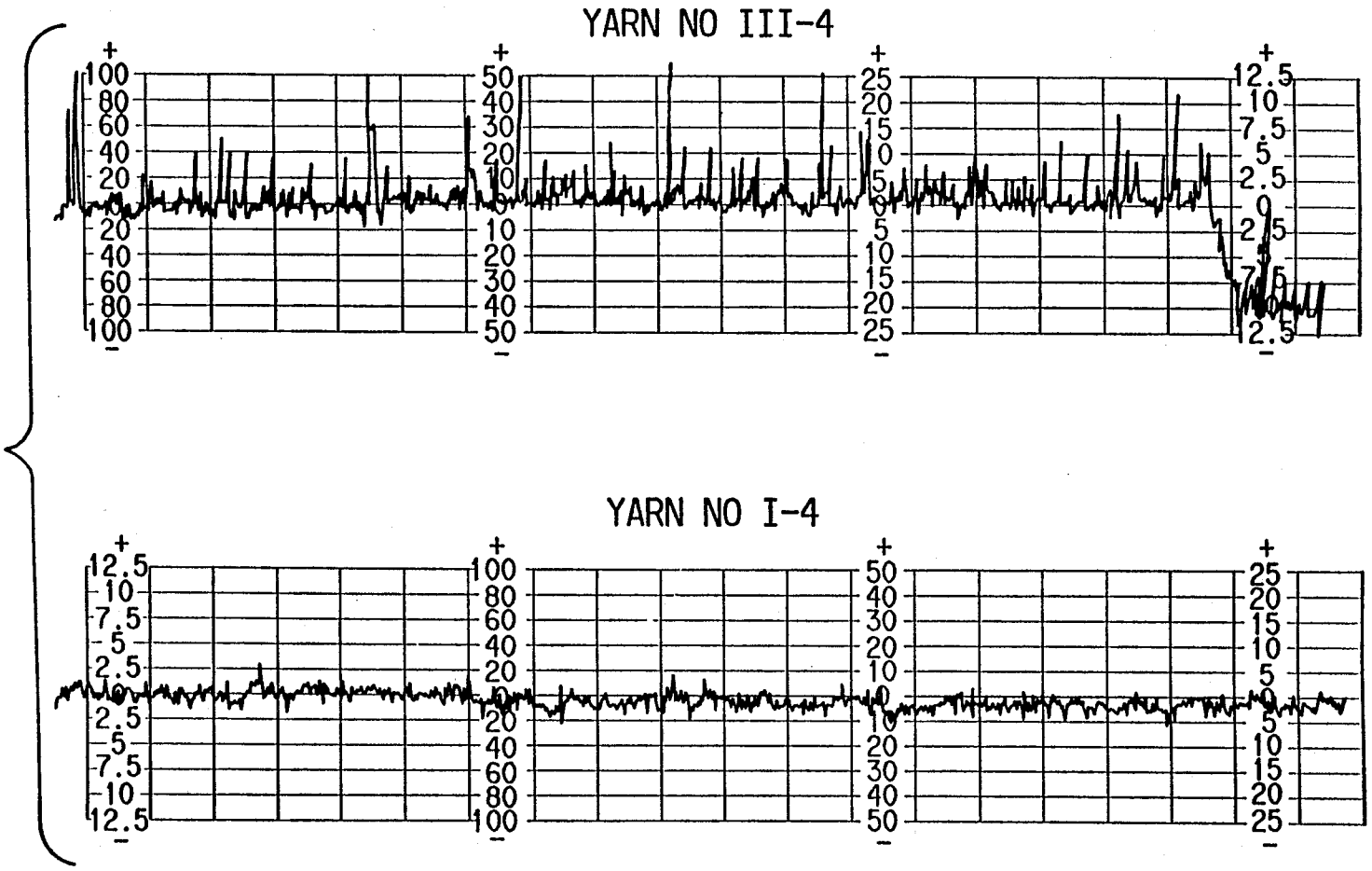

The dyed warp knit Jersey fabrics (III-1 through 6) had poorer uniformity than the corresponding test yarn fabrics (I-1 through 6) supporting the observation that conventional POY cannot be partially drawn as uniformly as the test feed yarn used here wherein selected combinations of initial yield properties and unique crystal structure provides a feed yarn that can be drawn to any residual draw ratio (hot or cold) and give a uniform yarn with acceptable tensiles and better thermal stability and dyeability than conventional drawn polyester. This can be illustrated by comparing the along-end denier uster traces of the actual drawn yarns. This has been done for three sets of yarns in FIGS. 7, 8 and 9. Thus FIG. 7 compares such Uster traces for control yarn III-1 vs. test yarn I-1, while FIG. 8 compares control yarn III-2 vs test yarn I-2, and FIG. 9 compares control yarn III-4 vs. test yarn I-4. The better uniformity of each such test yarn is very evident from each Figure.

Referring to Table IV, yarn IV-1 is a round nominal 75–40 filament yarn which was treated under different drawing and overfeed conditions on a single-end basis (IV-2 through IV-9). Drawing and/or heat treatments increase the orientation (birefringence, $\Delta n$) and density, $\rho$, of the test yarn IV-1. The initial tensiles as characterized by the initial modulus, M, and tenacity at 7% elongation ($T_7$) were enhanced, except for the modulus values of yarns IV-2, IV-4 and IV-6 which were obtained under these conditions: draw temperatures of about 100° C., presence of water, and drawing conditions ranging from slight relaxation to slight draw. The yarns are characterized by low shrinkage of less than 6% and low shrinkage tension (ST) less than 0.15 g/d, except for yarns IV-8 and 9 drawn 1.10X. All yarns had good dyeability similar to the feed yarn, except for yarns IV-7 and 9 drawn 1.05X and 1.10respectively, at 180° C., which have somewhat lower dyeability.

Figure 18:
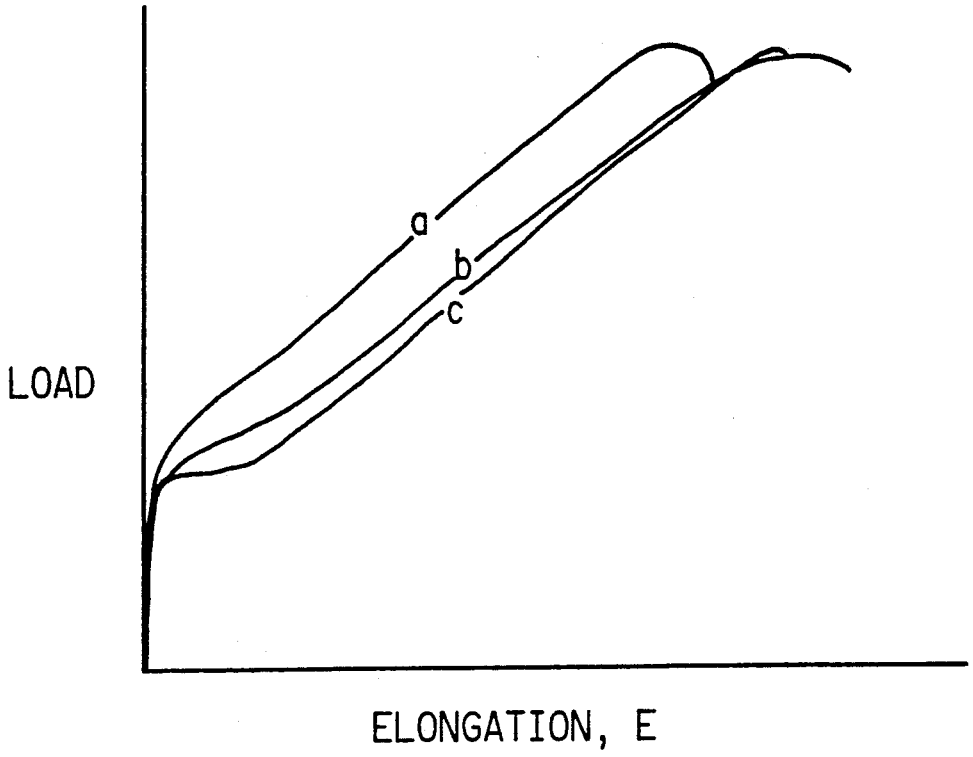
FIGS. 18–20 are more curves showing load plotted v. elongation.
Figure 19:
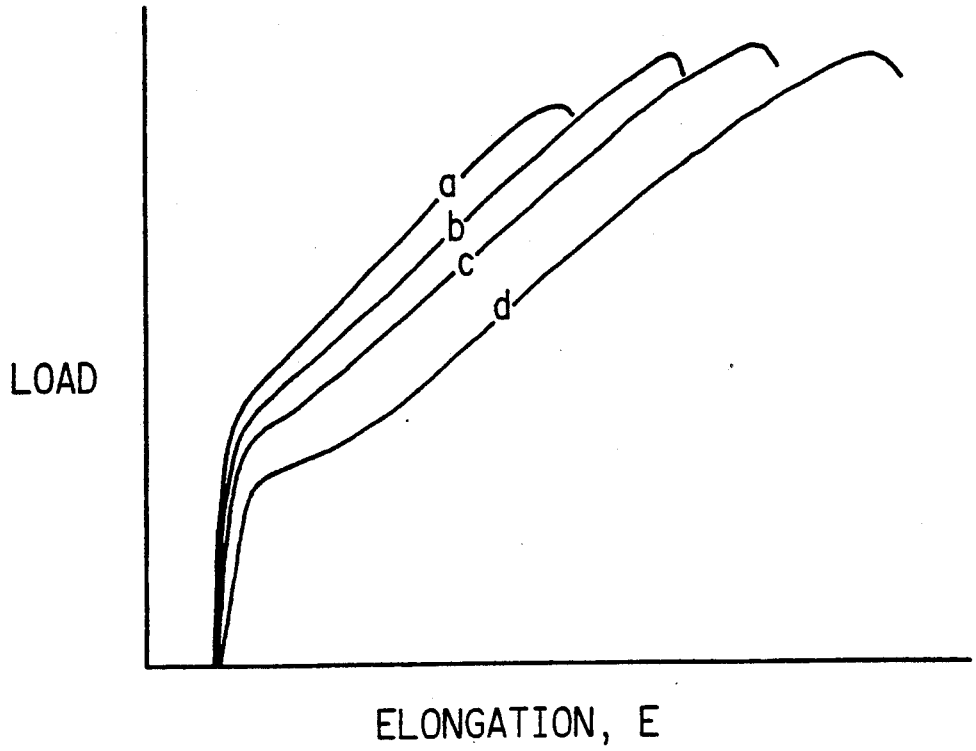
Figure 20:
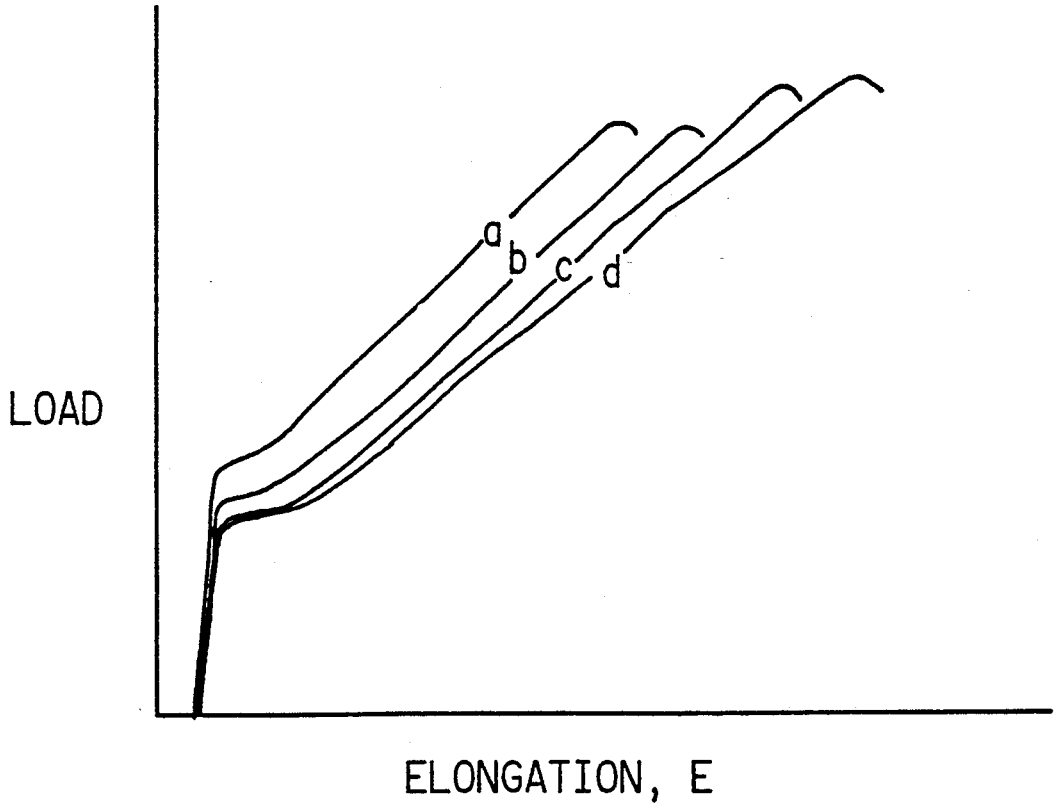

The improvements to the yarn mechanical properties by various heat treatments are further illustrated by comparison of the Load-Elongation curves of the yarns in Table IV. In FIG. 18, curves a, b and C represent yarns IV-3, IV-2 and IV-1, respectively, and are compared. In FIG. 19, curves a-d represent yarns IV-9, IV-7, IV-5, and IV-1 respectively, and are compared. In FIG. 20, curves a-d represent yarns IV-8, IV-6, IV-4, and IV-1, respectively, and are compared. In all cases, heat treatment, especially under tension or slight drawing, enhanced the mechanical properties of the test yarn IV-1 as a warp yarn for knitting and weaving.

The feed yarns are compared in Table V where V-1 and V-2 are commercially available POY used in the Example as the sources of control yarns II-1 and III-1 through 6, respectively, and V-3 is the test feed yarn used in the Example as the source of test yarns I-1 through 6, and is the direct-use yarn IC shown in Table I. The control feed yarns V-1 and V-2 differ significantly from the test feed yarn V-3 in that the yarns have lower yield points ($\sigma'_y$), longer yield zones (E''-'), and poorer thermal stability with boil-off shrinkages greater than 10%. The control feed yarns had densities less than 1.35 g/cm$^3$ and very small crystals giving diffuse scattering by wide-angle X-ray (WAXS).

Figure 10:
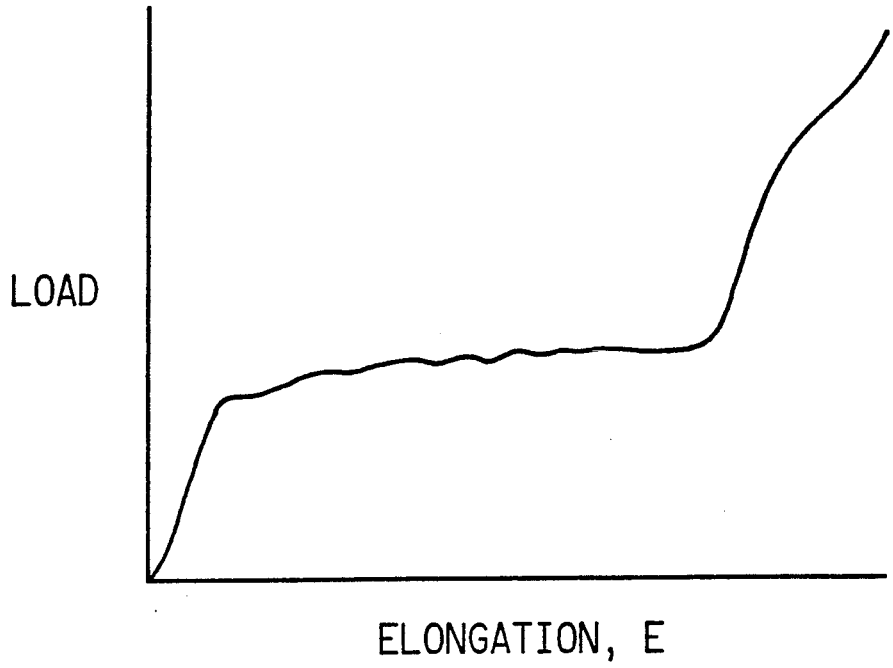
FIGS. 10–12 are curves showing load plotted v. elongation (-to-break).
Figure 11:
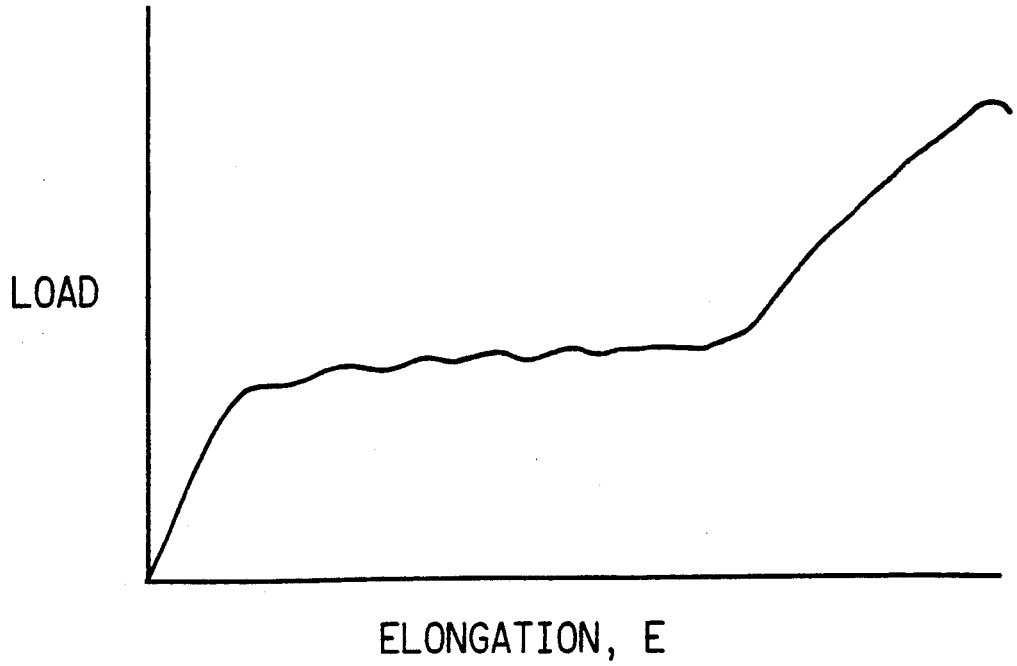
Figure 12:
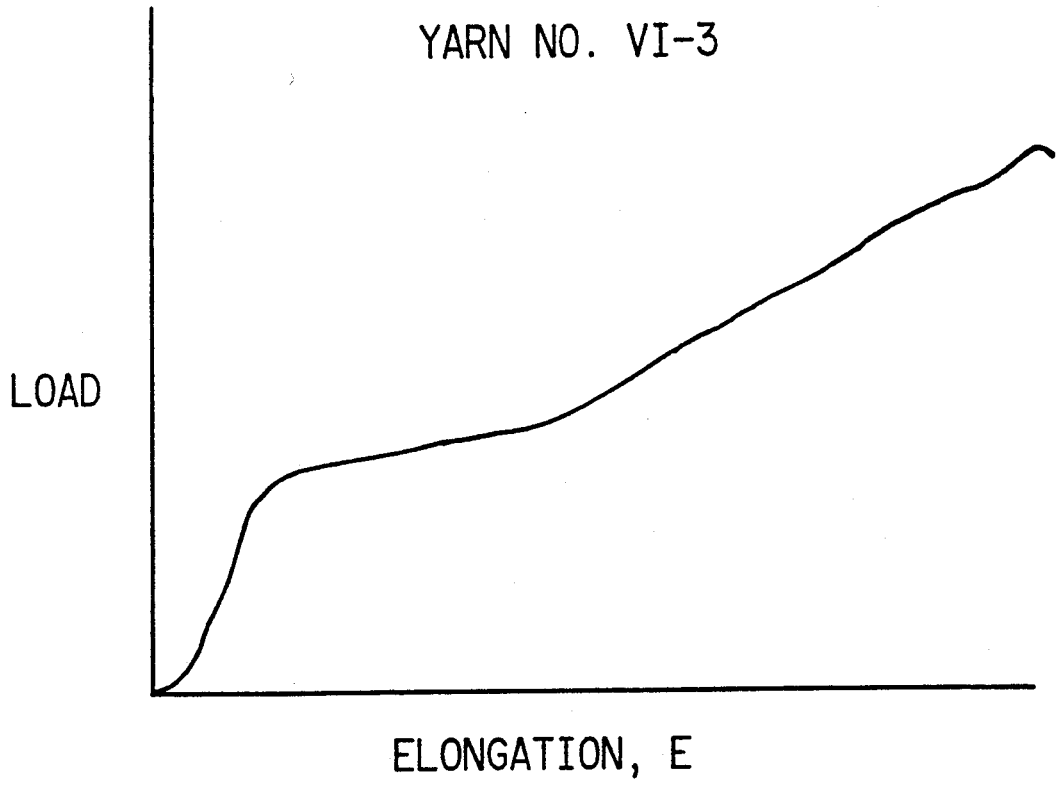

Additional feed yarns are compared in Table VI where yarns VI-1 and VI-2 are commercially available POY, similar to yarns V-1 and V-2 used in the Examples II and III, and are used as the sources of control yarns VII-1 through VII-6 and VIII-1 through VIII-6, X-1 through X-6 and XI-1 through XI-6, XIII-1 through XIII-8 and XIV-1 through XIV-8, respectively; and yarn VI-3 is the test feed yarn used as the source for test yarns IX-1 through IX-6, XII-1 through XII-6, and XV-1 through XV-5, and is similar to the direct-use yarn IC shown in Table I. The control feed yarns VI-1 and VI-2 differ significantly (from the test feed yarn VI-3) in that they have lower yield points ('y), longer yield zones (E''-E'), and poor thermal stability with boil-off shrinkages greater than 10%. The control feed yarns had densities less than 1.35 g/cm$^3$ and very small crystals giving diffuse scattering by wide-angle X-ray (WAXS). The load-Elongation curves are compared in FIGS. 10–12, and were obtained by drawing at 19° C./65% RH and 25 meters per minute using an along-end stress-stain analyzer manufactured entered by Micro Sensors Incorporated. The nonuniform neck yield region is very pronounced for the control yarns VI-1 and VI-2 in FIGS. 10 and 11, respectively, by the almost horizontal portions of the curves. The test yarn VI-3 does not exhibit neckdown, but uniform plastic flow behavior, as shown by its much more uniform along-end yield behavior in FIG. 12.

The commercially available POY VI-1 and VI-2 and the test yarn VI-3 were hot drawn at 100° C. (Tables VII–IX, respectively) and cold drawn (Tables X-XII, respectively) over a wide range of draw ratios on an experimental single-end warp draw unit giving yarns of varying residual draw ratio (RDR). The control yarns VI-I and VI-2, when partially drawn to RDR greater than about 1.3, had poor along end denier uniformity as shown by high values of relative Denier Spread, and relative Uster, and by short dark dye streaks (called mottle) in dyed knit tubing. The test yarn VI-3, however, could be partially drawn hot (Table IX) and cold (Table XII) to residual draw ratios (RDR) greater than about 1.3, and gave partially drawn yarns with acceptable along end denier uniformity and dyed knit tubing essentially free of dye defects. The control yarns could only be drawn uniformly when drawn hot (Tables VI-IX) or cold (Tables X-XII) to residual draw ratios (RDR) of less than about 1.3. The test yarns, however, still are preferred for drawing hot or cold to residual draw ratios less than about 1.3 as they gave improved along end uniformity (over the fully drawn control yarns) as indicated by lower values of relative along-end denier and Uster, and less visual dye defects (mottle) in the dyed knit tubing.

Figure 13:
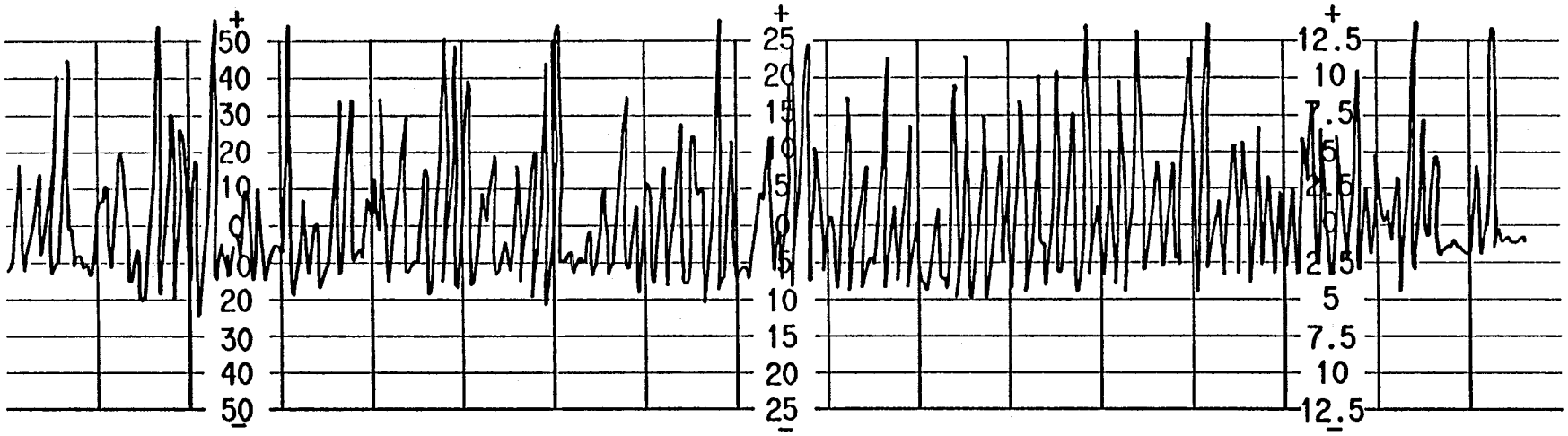
FIGS. 13–15 are more along-end denier Uster traces.
Figure 14:
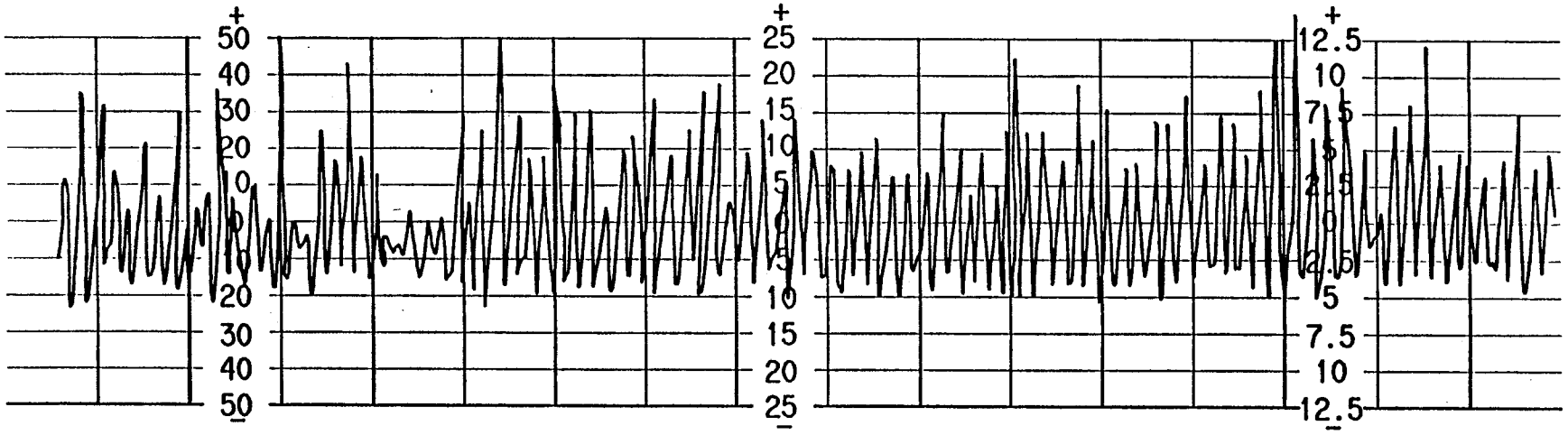
Figure 15:
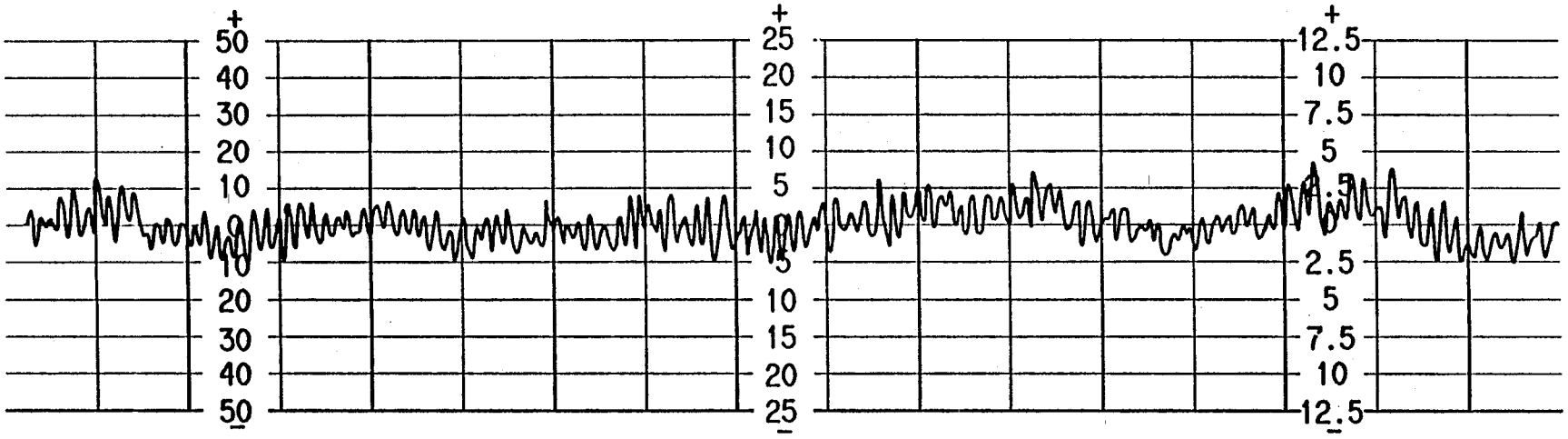
Figure 16:
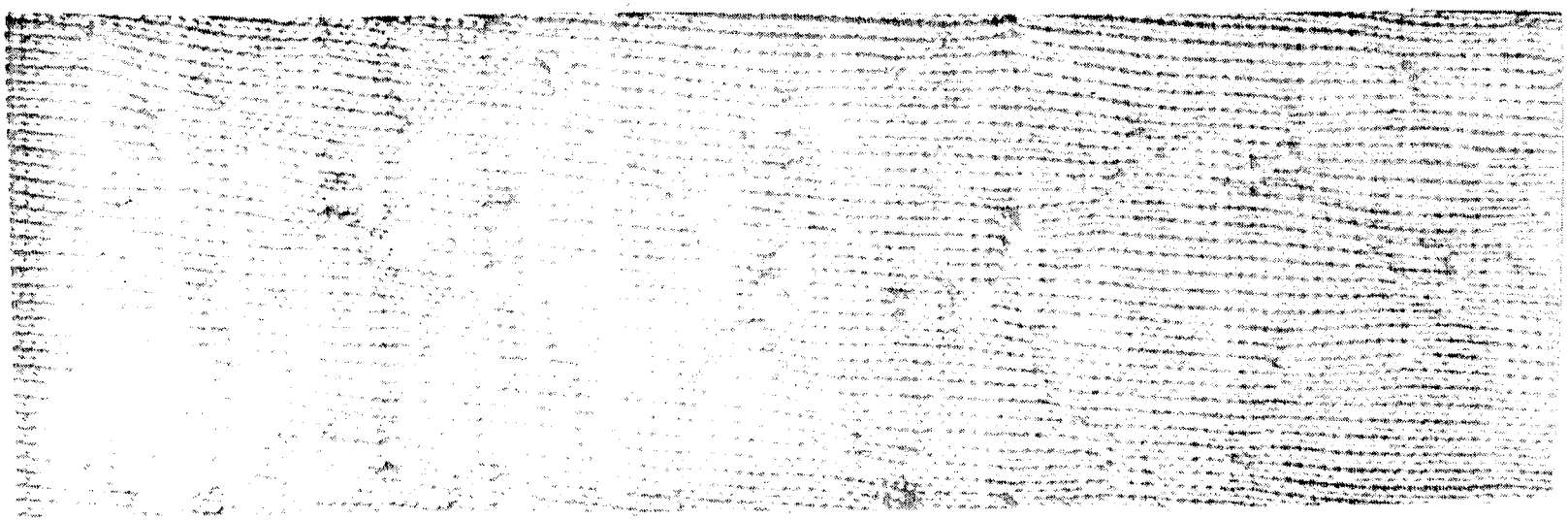
FIGS. 16 and 17 are photographs of dyed fabrics.
Figure 17:
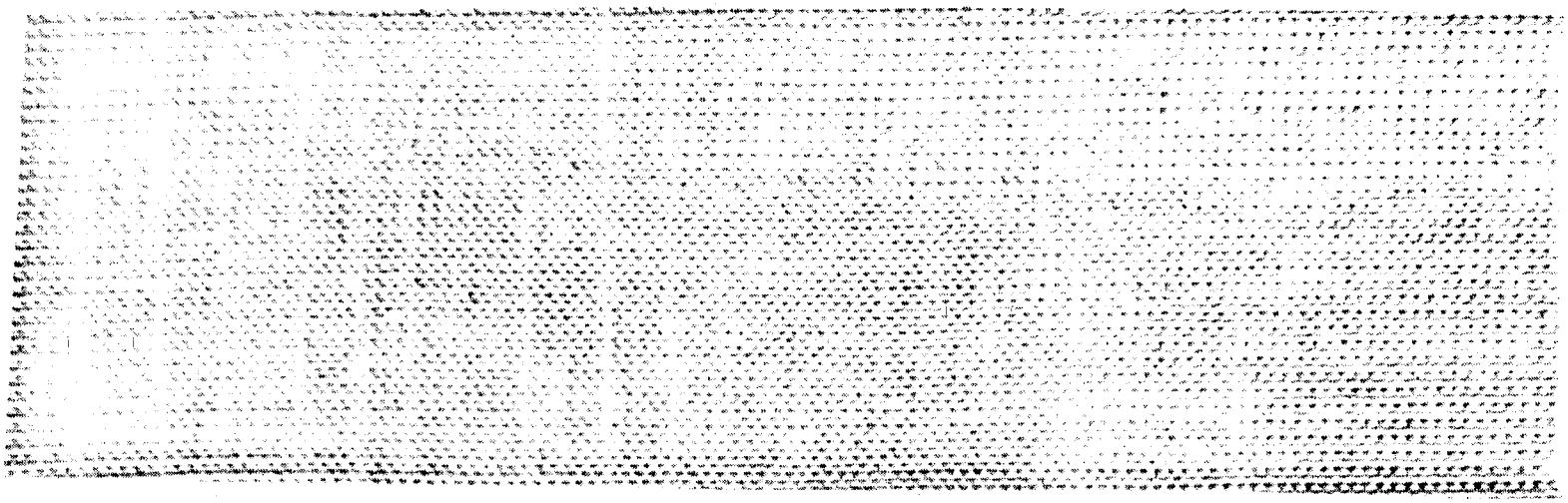

In FIGS. 13–15, along-end Uster traces are compared for the control yarns VII-2 and VIII-3 and test yarn IX-2, respectively, partially drawn hot to approximate residual draw ratios (RDR) of about 1.5X: that is to elongations in each of their respective "yield" regions. Only the test yarn had acceptable along-end Uster when partially drawn to within its yield region. The high relative Uster values of the control yarns (VII-2, for example) gave rise to pronounced dye mottle (DM) in dyed knit tubing while the test yarn IX-2 gave commercially acceptable uniformity with only a few faint dye streaks, as shown in FIGS. 16 and 17, respectively.

Another technique frequently used to define along end uniformity of the drawing process is the measurement of the coefficient variation (% CV) of the drawing tension (DT). In Tables XIII–XV, the control yarns VI-1 and VI-2 and the test yarn VI-3, respectively, were drawn over a wide temperature range from cold (the temperature in this case was defined here as 19° C.) i.e. at room temperature, with no external heat added, to 224° C., and over a wide range of draw-ratios (1.1 to 1.9X) giving a corresponding wide range of residual draw ratios (RDR) of about 1.15 to 2X, depending on the particularly feed yarn's starting elongation. The control yarns VI-1 and VI-2 could not be partially drawn hot or cold to residual draw ratios (RDR) greater than about 1.3–1.4 as indicated by their high along end draw tension %CV values greater than 2%. The test yarn VI-3 could be uniformly partially drawn hot and cold drawn over the entire draw ratio range tested as indicated by along end draw tension %CV values of less than 2%.

Warp beaming which includes a heat treatment to enhance yarn properties is incorporated, herein, as a form of "warp drawing" where the beaming can include relaxation, i.e., draw ratios of less than 1.0X, or restrained conditions, i.e., draw ratio of about 1.0X. Tenter Frames or Slasher units, for example, modified to incorporate warp beaming, are alternate forms of warp treatment of which warp drawing is currently the most common. However, the test yarn of this invention makes the alternate warp treatments commercially viable routes to obtain enhanced warp yarn properties.

The feed yarns for use in this invention are highly crystalline with excellent thermal stability and dyeability which characteristics may be essentially maintained after hot (or cold) drawing. These feed yarns are also capable of being drawn hot or cold uniformly to residual elongations greater than about 30%, which provides the flexibility of tailoring draw-warped yarns of given tensiles, shrinkage, and dyeability for specific end-use requirements. Conventional POY cannot provide this flexibility in a single feed yarn.

Polyester polymer LRV is determined as described in Broaddus U.S. Pat. No. 4,712,998 where 20.8 LRV corresponds approximately with [$\eta$] of 0.65.

NYLON FILAMENT EXAMPLES

These Examples are provided primarily in the form of Tables XVI and XVII. Four types of high speed spun undrawn nylon filaments suitable for cospinning (or co-mingling after having been wound up) with polyester undrawn filaments are summarized in Table XVI as items A, B, C and D, and the drawing of said four types of undrawn nylon filaments (A, B, C and D) are summarized in Tables XVIIA, XVIIB, XVIIC, and XVIID, respectively. The warp knit fabric ratings in Table XVII (denoted by LMDR=Large Molecule Dye Rating) were measured by the method described in Boles et al Application PCT/US91/04244 filed Jun. 21, 1991, as follows LARGE MOLECULE ACID DYE RATING (LMDR) Yarns were knitted into tricot fabric using a 32 gauge tricot machine and dyed by the following procedure using either C.I. Acid Blue 122 or C.I. Acid Blue 80:

This procedure is used to dye small quantities (~1-3 yards) of fabric. A weighed quantity or fabric is added to 30 liters of water at 110° F. in a cook washer. To this bath is added 3 g of Merpol HCS (a liquid nonionic detergent sold by E. I. du Pont de Nemours and Company) and 3 g of 10% ammoniun hydroxide. The bath temperature is raised to 160° F. at 3° F./minute and the cook washer is run for 15 minutes. Then the bath is emptied and cleared thoroughly and a 30 liters of water is added. The temperature is set at 80° F. and 0.5% on weight of fabric of Merpol DA (a non-ionic surfactant sold by E. I. du Pont de Nemours and Company) is added. The bath is run for 5 minutes to allow mixing, and 2% on weight of fabric of MSP (monobasic sodium phosphate) is added. The pH of the bath is adjusted to 6.0 with acetic acid. Then 6% on weight of fabric of ammonium sulfate is added and the bath is run for 5 minutes before adding 1.0% on weight of fabric of Du Pont Anthraquinone Milling Blue BL (C.I. Acid Blue 122) or Sandolin milling blue N-BL (C.I. Acid Blue 80). The bath is run for 5 minutes, and the bath temperature is then raised to 212° F. at 3° F./min. After running the bath for 50 minutes, the pH is measured. If the pH is >5.7, it is adjusted to 5.5 and run another 30 minutes. The bath is then cooled to 170° F., emptied, and cleared with clear water. Fabric is removed from the bath and dried.

The yarns in the fabrics were evaluated for LMDR as follows:

Fabric swatches (full width, i.e., approximately 60 inches wide and about 20-60 inches long) were laid on a large table covered with dull black plastic in a room with diffuse fluorescent lighting. The fabric is rated by a panel of experts (the ratings of 5 to 7 experts are averaged) on a scale from 1 to 10 as more further described below using as a guide, the computerized simulation of fabric streaks shown in FIGS. 23-32 of Boles et al Application PCT/US91/04244 referred to above.

Selected ratings on this rating scale are:

10=no defect visible, absolutely uniform;

8=minor unevenness observed but difficult to detect, acceptable for almost all end uses;

7=superior;

6.5=acceptable;

6=unevenness noticeable, usable for most apparel;

5=unacceptable except for second grade apparel;

4=unevenness highly noticeable, too uneven for any apparel; and

2=extremely uneven, disastrously defective;

Acceptable dyed fabric uniformity is defined as that suitable for critically dyed fabrics for use in automotive upholstery and fashion swimwear herein are denoted by a + sign in Table XVII.

Nylon polymer RV in Tables XVI and XVII are determined as described at Col. 2, lines 42-51, in Jennings U.S. Pat. No. 4,702,875.

The undrawn nylon filaments used according to this invention are selected to provide dimensional stability; that is, are selected to avoid or minimize any tendency to spontaneously elongate (grow) at moderate temperatures (referred to in degrees C.) e.g., over the temperature range of 40 to 135, as measured by the dynamic length change ($\Delta L_{135-40}$)-value less than 0 under a 5 mg/d load at a heating rate of 50/minute as described in Knox et al EP A1 0411774 (page 18, lines 43 thru 56) and is similar to a stability criterion ($TS_{140\ C}$-$TS_{90\ C}$) described by Adams in U.S. Pat. No. 3,994,121 (Col. 17 and 18). In conventional spinning of undrawn nylon filaments, dimensional stability, as described hereinabove, is provided by treating the freshly extruded filaments, prior to winding, with steam (Adams U.S. Pat. No. 3,994,121) or dry heat (Koschinek U.S. Pat. No. 4,181,697). Dimensional stability can also be provided without thermal treatments of any kind by spinning nylon polymer of conventional RV (35-45) at spinning speeds greater than about 5 Km/min (Koschinek U.S. Pat. No. 4,181,697); by spinning nylon polymer of RV greater than 46, preferably greater than about 53 RV, at spinning speeds greater than 3.5 Km/min (Chamberlin, et al. U.S. Pat. No. 4,583,357); by spinning conventional RV nylon containing minor amounts of chainbranching agents at spin speeds greater than about 3.5 Km/min (Nunning, et al. U.S. Pat. No. 4,721,650); or by spinning nylon polymer of RV greater than about 50 containing minor amounts of copolyamides, e.g., 5% by weight of nylon 6, or 5% by weight of 2-methyl-pentamethylene adipamide comonomer at spin speeds greater than about 4.5 Km/min (Knox, et al EP A1 0411774). Preferably, the undrawn polyester/-nylon mixed filament yarns are prepared by a process in which the dimensional stability of the undrawn nylon filaments is provided without use of steam or dry heat, since it may not always be desirable to heat treat the undrawn polyester filaments. In such cases, if needed, separate yarn paths can be used to permit heat treatment of just the nylon filaments prior to combining them with un(heat)treated polyester filaments. However, a simplified cospinning process is preferred wherein dimensionally stable nylon filaments are formed without use of steam or thermal treatments by selecting nylon polymer (base polymer type, RV, amount of copolymers and/or chainbranchers) such that spinning at speeds greater than about 3.5 Km/min, preferably greater than about 4 Km/min, is sufficient to develop dimensional stability without having to use steam or dry heat treatments.

For instance, Table XVI shows how undrawn nylon filaments for our mixed feed yarns may be spun without need for thermal stabilization by spinning nylon 66 polymer of 50 RV at about 3.9 Km/min (Table XVI-1 and 2) and by spinning nylon 66 polymer of 65 RV (Table XVI-3) and nylon 6/66 of 65 RV containing 5% by weight of nylon 6 (Table XVI-4) at 5.3 Km/min. We have found that selecting nylon polymer and spinning speed to provide undrawn nylon filaments with an elongation ($E_B$) less than about 90% is usually sufficient to achieve dimensional stability ($\Delta L_{135-40}$). The relationship of elongation ($E_B$) v spinning speed is discussed hereinafter with reference to FIG. 21 of the accompanying drawings. Polymer RV, amount of copolyamide, and spinning speed (Km/min) are preferably selected for nylon using the following relationship to provide dimensionally stable undrawn nylon filaments with elongations less than about 90%: $RV<[0.0133V-(6.5-X)]$, wherein V is the spinning speed (in Km/min) and is between about 3.5 and about 6.5 (preferably between about 4 and about 6), polymer RV is between about 40 and about 80 (preferably between about 50 and about 70), and polymer is nylon 66 which may be modified with up to about 10% by weight of copolyamides, any such percentage amount being denoted by X. If minor amounts of chainbranching agents (typically about 0.02 to about 0.12 mole percent) are incorporated into the nylon polymer, then lower RV polymer and/or higher spin speeds may be used to obtain the same desirable undrawn yarn elongation. This may be preferred rather than raising the nylon polymer RV by solid phase polymerization.

In Examples XVI-3 and -4, nylon polymer of 65 RV was spun at a nominal spin speed of 5.3 Km/min to form dimensionally stable undrawn nylon filaments having elongations-to-break ($E_B$) on the same order as that in Example XVI-2 (spun at slower spin speed and lower RV). Examples XVI-3 and -4 illustrate the use of high polymer RV and of incorporating a minor amount of copolyamide (e.g., 5% nylon 6 in nylon 66 - denoted as N6/66 in Example XVI-4) to increase or maintain spun yarn elongation with increasing spinning speeds and thus to better match the typically higher spun elongations of the polyester filaments. Examples of other suitable undrawn filament yarns suitable for combining with undrawn polyester yarns of the invention are described in Knox, et al (EP A1 0411774).

MIXED FILAMENTS

The undrawn polyester/nylon mixed filament yarns, according to this invention, may be uniquely drawn, fully or partially, cold or hot, with or without post heat treatment, to provide uniform drawn yarns, to residual elongations of at least about 1.2 (that is, drawn such that the residual elongation-to-break of the component having the lowest elongation is at least about 20%) so to avoid the likelihood of forming broken filaments which may be unsuitable for certain textile end-uses. The maximum draw ratio ($DR_{MAX}$) without broken filaments is herein defined by the elongation of the undrawn component having the lowest elongation prior to drawing: $(DR_{MAX})=(RDR)_{F,L}/1.2$. Since both components of the mixed feed yarn of this invention may be partially drawn, there is no lower limit for the draw ratio, except as required to maintain a stable threadline during drawing and subsequent winding of package or beam. To maximize drawing productivity, it is preferred to select components such that any difference in elongations between the undrawn polyester $(E_B)_P$ and nylon $(E_B)_N$ filaments be less than about 10%, preferably less than about 5%.

Figure 21:
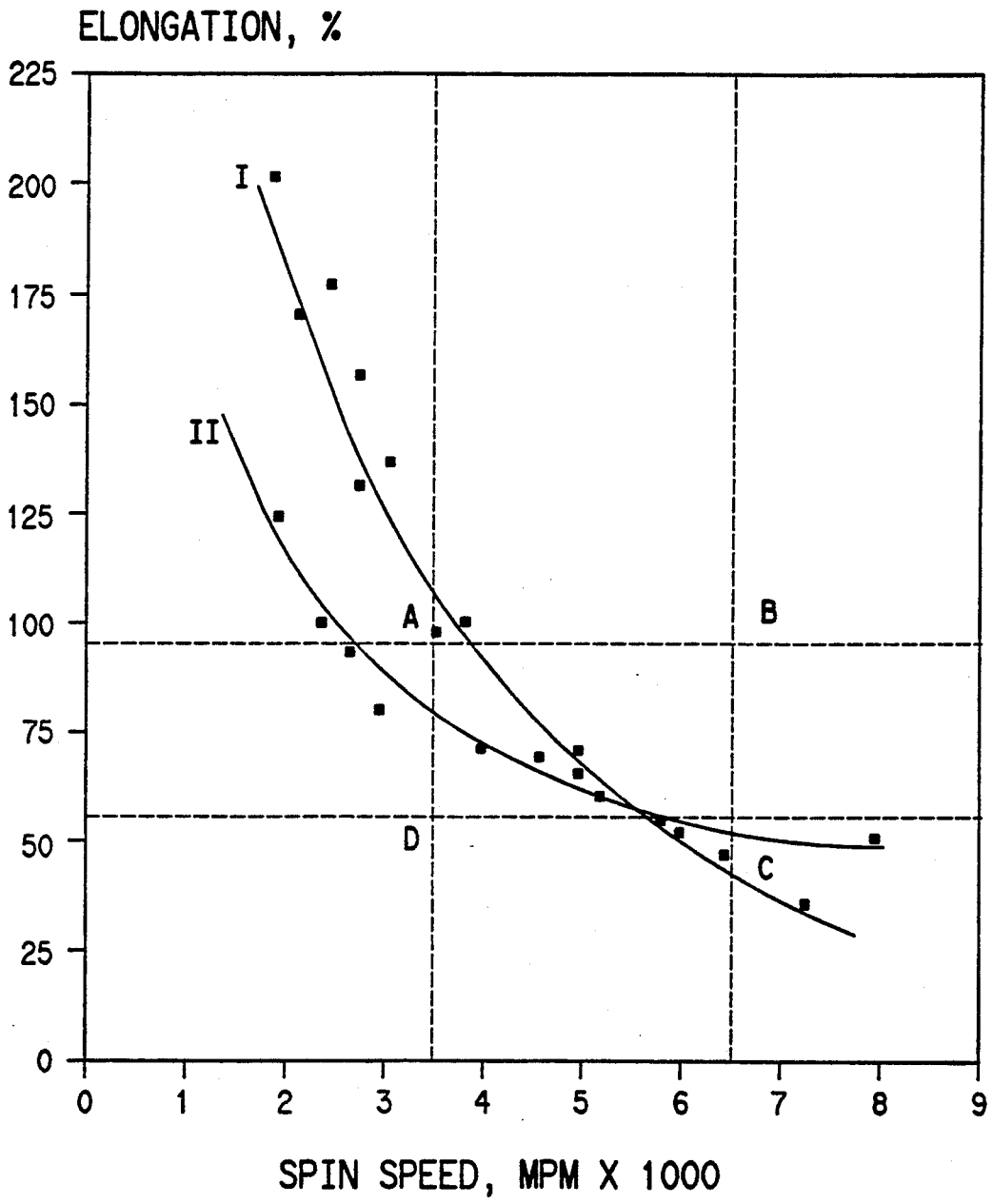
FIGS. 21 and 22 are curves that show, respectively, elongations-to-break ($E_B$) and boil-off shrinkages ($S_1$), each plotted v. spinning speed.

Referring to FIG. 21, for example, to obtain a better match between the elongations of undrawn polyester and nylon filaments, one may compare how typical elongation values for polyester (I) and for nylon (II) vary with different spin speeds. Between about 3.5 Km/min and 6.5 Km/min (denoted by region ABCD in FIG. 21) and especially between about 4 and 6 Km/min, the elongations of undrawn polyester and nylon filaments are of the same order. The elongation of the undrawn nylon filaments may be increased by increasing polymer RV (Chamberlin U.S. Pat. No. 4,583,357 and 4,646,514), by use of chainbranching agents (Nunning U.S. Pat. No. 4,721,650), or by use of selected copolyamides and higher RV (Knox EP A1 0411774). The elongation of the undrawn polyester may be increased by lower intrinsic viscosity and use of copolyesters (Knox U.S. Pat. No. 4,156,071 and Frankfort and Knox U.S. Pat. Nos. 4,134,882 and 4,195,051), and by incorporating minor amounts of chainbranching agents (MacLean U.S. Pat. No. 4,092,229, Knox U.S. Pat. No. 4,156,051 and Reese U.S. Pat. Nos. 4,883,032, 4,996,740, and 5,034,174). The elongation of polyester filaments is especially responsive to changes in filament denier and shape, with elongation decreasing with increasing filament surface-to-volume (i.e., with either or both decreasing filament denier and non-round shapes).

Figure 22:
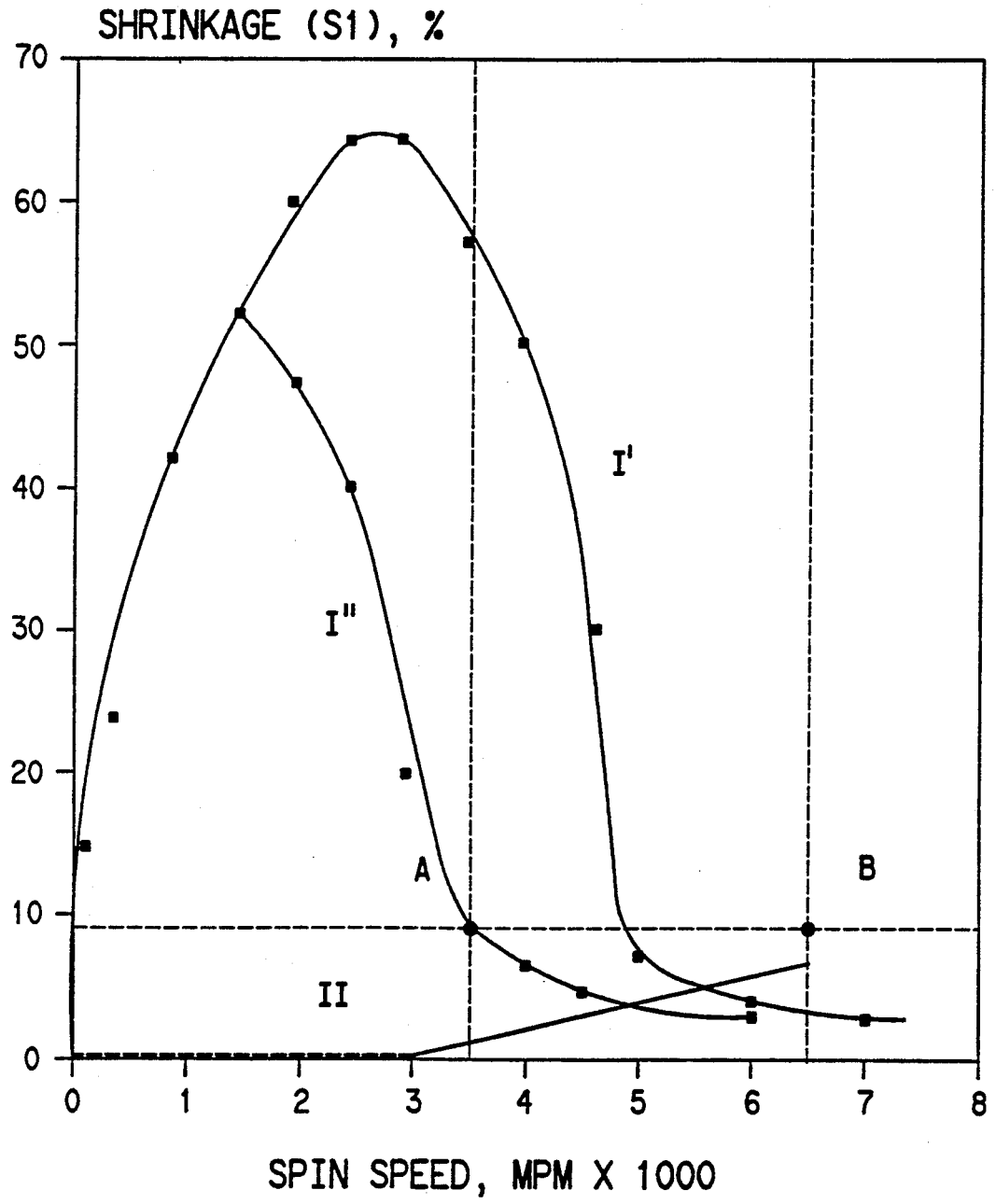

Referring to FIG. 22, the variations of shrinkage ($S_1$) vs spinning speed are compared for conventional undrawn polyester POY (I') and of undrawn polyester feed filaments used herein (I'') with that of undrawn nylon filaments (II). Undrawn polyester yarns with shrinkages less than about 10% (for instance, those below the line AB in FIG. 22) are found to have drawing characteristics comparable to those of undrawn nylon filaments. The $S_1$ shrinkage of polyester filaments spun at any particular speed may, for example, be decreased to be comparable to that of (I''), by raising the polymer viscosity, increasing filament surface-to-volume ratio, using a chainbrancher, lowering polymer melt viscosity via reduced bulk polymer temperature and/or capillary shear, and shorter delay quench lengths. Selection of polyester polymer (RV, amount and type of comonomers, and chainbranching agents) and spinning parameters are made to obtain the desired shrinkage and elongation to match those of the nylon filaments for making the preferred polyester/nylon mixed filament yarns of the invention. The overall shrinkage of the drawn polyester/nylon mixed filament yarns is typically determined by the shrinkage of the drawn nylon filaments, herein, since the latter usually have a higher shrinkage potential than the drawn polyester filaments of the invention. The shrinkages of the drawn nylon filaments vary in range between about 6 and 10% for nylon 66, and between about 8 to 12% for nylon 6, with shrinkages in the lower end of the range being obtainable by heat relaxing the drawn filaments. The shrinkages of the cold drawn polyester filaments are typically 6 to 10% without heat setting, and may be as low as about 2–3% with heat setting. A mixed shrinkage drawn filament yarn may be obtained by cold or hot co-drawing the said polyester/nylon mixed filament yarns followed by mild heat-relaxing (e.g., up to about 10% overfeed at less than about 150 C.), whereby the shrinkage of the polyester filaments may be typically reduced to a greater extent than that of the nylon filaments.

The uniformity of co-drawn polyester/nylon mixed filament yarns wherein the nylon filaments are dyed with large acid-dye molecules (such as are used in critically dyed warp knits for automotive upholstery and swimwear) may not be satisfactory if the co-drawn yarns are heat-set above about 150 C. It has been found that the along-end dye uniformity of nylon with large molecule acid dyes (such as Anthraquinone Milling Blue BL - Color Index Acid Blue 122) is reduced to unsatisfactory levels if drawn to low elongations (low RDR values) with heat setting at high temperatures. Acceptable along-end dye uniformity is achieved if the extent of drawing and heat setting are balanced as described by the relationship:

$$[1000/(T_R+273)] >/= [4.95-1.75(RDR)_D],$$

wherein, $T_R$ is the heat relaxation temperature (in degrees C), and $(RDR)_D$ is the residual draw ratio of the drawn nylon filaments defined by $(1+E_B,\%/100)_D$.

Figure 23:
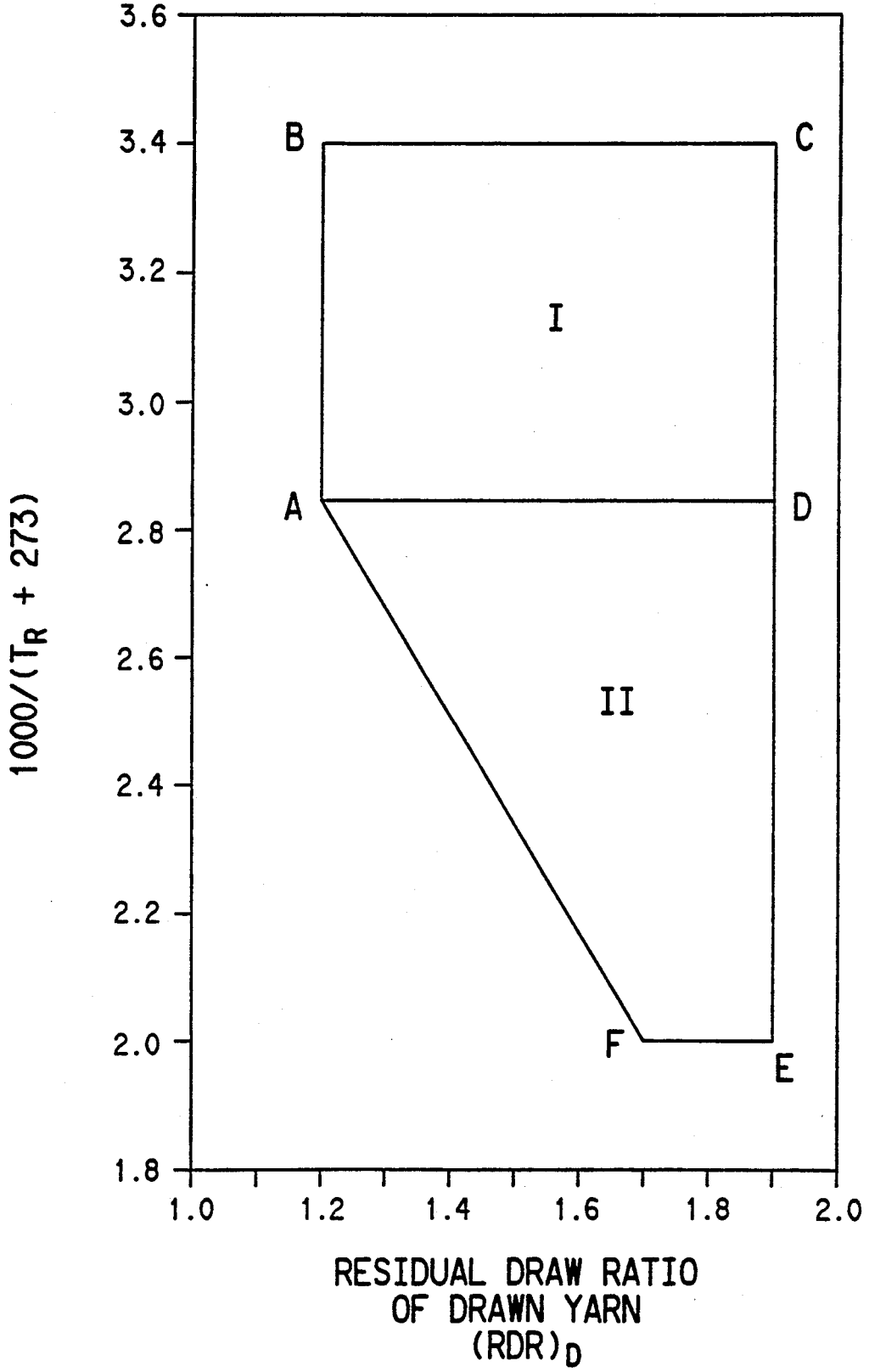
FIG. 23 shows a relationship between the heat relaxation temperature ($T_R$) and the residual draw ratio of drawn yarns $(RDR)_D$.

FIG. 23 shows the relationship between $T_R$ and $(RDR)_D$ for nylon graphically by a plot of $[1000/(T_R+273)]$ vs. $(RDR)_D$. Drawn filaments, suitable for critically dyed end-uses are obtained by selecting conditions met by the regions I (ABCD) and II (ADEF). Mixed-shrinkage yarns suitable for critically dyed end-uses are preferably obtained by cold or hot drawing the polyester/nylon mixed yarns followed by heat relaxing to reduce the shrinkage of the polyester filaments by selecting relaxation temperatures $T_R$ characteristic of Region II (ADEF). Co-drawn filament yarns wherein shrinkages of the polyester and nylon filaments are similar with maximum dyeability (that is dye rate) are preferably drawn cold (e.g., less than about 70° C., the nominal $T_G$ of polyester filaments) and heat set at temperatures less than about 90 C., as represented by Region I (ABCD).

The drawn polyester/nylon textile yarns prepared by the invention are suitable for critically dyed end-uses and have the unique advantage (especially if prepared by cold drawing without heat setting) of being capable of being dyed using conditions typical of nylon; (that is, under atmospheric conditions and without the use of organic carriers used in dyeing of conventional drawn polyester yarns); wherein, disperse dyestuffs are used to dye the polyester filaments and disperse or acid dyestuffs are used to dye the nylon filaments. If cationically modified polyester and/or nylon filaments are prepared by incorporation of typically 1 to 3 mole % of ethylene 5-M-sulfo-isophthalate, wherein M is an aklali metal cation (such as sodium), then cationic dyestuffs may be used.

Uniform drawing of the undrawn polyester/nylon feed yarns of the invention may be carried out in a coupled spin draw process, a split single-end process (including draw air-jet and false-twist texturing), and in a draw-warping process, wherein said drawing may be done cold (i.e., without external heating) or hot with or without heat setting to provide drawn filaments having a residual elongation of at least about 20%, and even may be uniformly partially drawn with residual elongations of at least about 30%. In contrast, uniform drawing of a polyester/nylon feed yarn to elongations greater than about 30% would not be possible if one were to try to use the same processing conditions on a feed yarn in which the polyester filaments were of conventional POY (such as described by Piazza and Reese, U.S. Pat. No. 3,772,872) with shrinkages greater than about 10%, such filaments would give the results taught in Schippers U.S. Pat. No. 4,019,311. The combination according to the invention is of polyester undrawn filaments, characterized herein by low shrinkage and large crystals, with dimensionally stable nylon undrawn filaments, characterized by polymer RV greater than about 40, especially greater than about 50, with both filament types formed by spinning at speeds greater than about 3.5 Km/min, preferably greater than about 4 Km/min, such to provide polyester and nylon filaments both having elongations less than about 90% and shrinkages ($S_1$) less than about 10%, preferably by co-spinning the polyester and nylon filaments and winding up a mixed feed yarn for co-drawing.

TABLE I

| YARN NO. | I-1 | I-2 | I-3 | I-4 | I-5 | I-6 | IA | IB | IC |
|---|---|---|---|---|---|---|---|---|---|
| Undrawn Denier | 108.0 | 108.0 | 108.0 | 108.0 | 108.0 | 108.0 | 70.6 | 69.3 | 108.0 |
| Drawn Denier | 81.8 | 91.5 | 92.2 | 93.9 | 93.2 | 83.6 | — | — | — |
| Filaments - Shape | 50 TRI | 50 TRI | 50 TRI | 50 TRI | 50 TRI | 50 TRI | 34 TRI | 34 RND | 50 TRI |
| $TiO_2$, % | 0.035 | 0.035 | 0.035 | 0.035 | 0.035 | 0.035 | 0.10 | 0.10 | 0.035 |
| Viscosity, [η] | 0.65 | 0.65 | 0.65 | 0.65 | 0.65 | 0.65 | 0.656 | 0.61 | 0.65 |
| WARPING CONDITIONS | | | | | | | | | |
| Draw Ratio, Speeds | | | | | | | | | |
| Warp Draw Ratio (WDR) | 1.34 | 1.18 | 1.18 | 1.18 | 1.30 | 1.47 | — | — | — |
| Take-Up Speed (m/min) | 500 | 500 | 500 | 500 | 500 | 500 | — | — | — |
| Relax/Overfeed (%) | 0 | 0 | 0 | 0 | 10 | 10 | — | — | — |
| Effective WDR (EWDR) | 1.34 | 1.18 | 1.18 | 1.18 | 1.17 | 1.32 | — | — | — |
| Temperatures (°C.) | | | | | | | | | |
| Feed Polls | 60 | 60 | 60 | 60 | 60 | 60 | — | — | — |
| Preheat Plate | 86 | 86 | 86 | RT | RT | RT | — | — | — |
| Draw Pin | 95 | 95 | 95 | OFF | OFF | OFF | — | — | — |
| Set Plate | 170 | 170 | 195 | RT | RT | RT | — | — | — |
| Relax Plate | RT | RT | RT | RT | 195 | 195 | — | — | — |
| YARNS | | | | | | | | | |
| Shrinkages - AW, 5 mg/d | | | | | | | | | |
| Boil-Off, $S_1$ (%) | 5.9 | 4.4 | 2.3 | 8.9 | 2.8 | 1.7 | 6.7 | 7.0 | 3.4 |
| Thermal Stability, $S_2$ (%) | 1.2 | 0.7 | 1.2 | (1.6) | 0.2 | 1.1 | 5.1 | 5.3 | (0.3) |
| Net, $S_{12}$ (%) | 7.1 | 5.1 | 3.5 | 7.3 | 3.0 | 2.8 | 11.8 | 12.3 | 3.1 |
| Tension, ST (g/d) | 0.42 | 0.24 | 0.22 | 0.17 | 0.03 | 0.04 | 0.22 | 0.22 | 0.07 |
| Tensiles - AW | | | | | | | | | |
| Modulus, M (g/d) | 84.4 | 70.9 | 76.0 | 58.7 | 61.0 | 70.4 | 117.6 | 99.9 | 49.5 |

TABLE I-continued

| YARN NO. | I-1 | I-2 | I-3 | I-4 | I-5 | I-6 | IA | IB | IC |
|---|---|---|---|---|---|---|---|---|---|
| Ten. at 7%, $T_7$, (g/d) | 2.2 | 1.7 | 1.8 | 1.4 | 1.3 | 1.8 | 3.7 | 3.1 | 0.9 |
| Ten. at 20%, $T_{20}$ (g/d) | 3.6 | 2.5 | 2.8 | 2.1 | 2.4 | 3.4 | 4.8 | 4.1 | 1.4 |
| PY Modulus, PYM (g/d) | 15.1 | 9.1 | 11.0 | 7.9 | 11.5 | 16.6 | 13.8 | 12.3 | 5.5 |
| Elongation, $E_B$ (%) | 25.4 | 42.8 | 40.0 | 48.4 | 45.2 | 30.7 | 24.9 | 25.2 | 74.9 |
| Tenacity, T (g/d) | 3.7 | 3.2 | 3.4 | 3.0 | 3.2 | 3.7 | 5.1 | 4.3 | 2.7 |
| Tensiles - ABO | | | | | | | | | |
| Modulus, M (g/d) | 55.7 | 50.5 | 63.9 | 45.1 | 47.8 | 54.6 | 54.6 | 52.1 | 54.8 |
| Ten. at 7%, $T_7$ (g/d) | 1.7 | 1.3 | 1.6 | 1.0 | 1.2 | 1.5 | 1.3 | 1.4 | 1.0 |
| Ten. at 20%, $T_{20}$ (g/d) | 3.1 | 2.1 | 2.5 | 1.7 | 2.3 | 3.3 | 3.3 | 3.6 | 1.4 |
| PY Modulus, PYM (g/d) | 14.6 | 8.7 | 9.9 | 7.5 | 11.4 | 18.1 | 19.7 | 21.7 | 4.7 |
| Elongation, $E_B$ (%) | 31.2 | 48.0 | 43.2 | 56.4 | 44.2 | 28.1 | 32.5 | 33.7 | 84.4 |
| Tenacity, T (g/d) | 3.4 | 3.0 | 3.2 | 2.8 | 3.0 | 3.4 | 3.6 | 3.8 | 2.6 |
| Tensiles - ADH | | | | | | | | | |
| Modulus, M (g/d) | 70.6 | 63.8 | 66.6 | 53.4 | 62.9 | 62.0 | 51.7 | 53.6 | 43.9 |
| Ten. at 7%, $T_7$ (g/d) | 1.5 | 1.3 | 1.4 | 1.1 | 1.4 | 1.5 | 1.1 | 1.2 | 1.1 |
| Ten. at 20%, $T_{20}$ (g/d) | 3.2 | 2.3 | 2.4 | 1.9 | 2.4 | 3.4 | 2.2 | 2.1 | 1.3 |
| PY Modulus, PYM (g/d) | 17.2 | 10.5 | 10.6 | 8.5 | 10.6 | 19.0 | 11.2 | 9.5 | 2.9 |
| Elongation, $E_B$ (%) | 34.2 | 50.1 | 47.3 | 56.0 | 43.8 | 27.3 | 41.3 | 43.4 | 87.3 |
| Tenacity, T (g/d) | 3.6 | 3.1 | 3.3 | 3.0 | 3.2 | 3.5 | 3.6 | 4.1 | 2.8 |
| Crystallniity - $AW_3$ | | | | | | | | | |
| Density, $\rho$ (g/cm$^3$)* | 1.3810 | 1.3869 | 1.3998 | 1.3815 | 1.3864 | 1.3880 | 1.3758 | 1.3764 | 1.3624 |
| Crystal Size, CS (Å) | 75 | 73 | 71 | 64 | 71 | 72 | 56 | 44 | 66 |
| Dyeability - AW | | | | | | | | | |
| Yarn Pel. Disp. Dye Rate (RDDR) | 0.093 | 0.123 | 0.121 | 0.154 | 0.129 | 0.098 | 0.062 | 0.045 | 0.164 |
| Fabric Dye Uptake (K/S) | 9.0 | 12.6 | 13.1 | 13.3 | 13.0 | 9.9 | 6.5 | 8.7 | 16.2 |
| FABRICS | | | | | | | | | |
| Fabric Type | | | | ← Jersey Warp Knit → | | | | | |
| Course × Wale, greige | 62 × 35 | 58 × 34 | 57 × 34 | 59 × 33 | 55 × 36 | 55 × 36 | 60 × 34 | — | 60 × 34 |
| Course × Wale, finished | 58 × 52 | 59 × 47 | 58 × 44 | 56 × 50 | 54 × 46 | 53 × 48 | 58 × 34 | — | 60 × 34 |
| Area Wt. (oz/yd$^2$), greige | 3.88 | 4.12 | 4.18 | 4.09 | 4.27 | 3.87 | 3.44 | — | 4.58 |
| Area Wt. (oz/yd$^2$), finished | 5.26 | 5.37 | 5.21 | 5.76 | 5.12 | 4.82 | 4.98 | — | 5.46 |
| ΔWt./Area (%) | 35.6 | 30.3 | 24.6 | 40.8 | 19.9 | 24.5 | 44.8 | — | 19.2 |
| Mullen Burst (lbs/in) | 135 | 111 | 103 | 101 | 101 | 118 | 124 | — | 84 |
| Burst Strength $\left(\frac{lb \cdot yd^2}{oz \cdot in}\right)$ | 25.7 | 20.7 | 19.8 | 17.5 | 19.7 | 24.5 | 24.9 | — | 15.4 |
| Dyed Fabric Rating (1 = worst; 5 = no defect) | | | | | | | | | |
| Long Streaks (LS) | 5 | 4 | 4 | 5 | 4 | 2 | 5 | — | 5 |
| Short Streaks (SS) | 3 | 3.5 | 4 | 4.5 | 4 | 4 | 4 | — | 3 |
| Dye Mottle (DM) | 5 | 5 | 5 | 5 | 4 | 4 | 5 | — | 5 |
| Deep Dye Streaks (DDS) | 5 | 5 | 5 | 5 | 5 | 5 | 5 | — | 5 |
| Average Rating (AR) | 4.5 | 4.4 | 4.5 | 4.9 | 4.25 | 3.75 | 4.75 | — | 4.5 |

TABLES II and III

| YARN NO. | II-1 | III-2 | III-1 | III-3 | III-4 | III-5 | III-6 |
|---|---|---|---|---|---|---|---|
| Undrawn Denier | 114.6 | 106.7 | 106.7 | 106.7 | 106.7 | 106 | 106.7 |
| Warped Denier | 74.4 | 70.6 | 80.2 | 79.7 | 81.4 | 82.4 | 71.1 |
| Filaments - Shape | 34 TRI | 34 RND | 34 RND | 34 RND | 34 RND | 34 RND | 34 RND |
| $TiO_2$, % | 0.035 | 0.30 | 0.30 | 0.30 | 0.30 | 0.30 | 0.30 |
| Viscosity, [η] | 0.658 | 0.656 | 0.656 | 0.656 | 0.656 | 0.656 | 0.656 |
| WARPING CONDITIONS | | | | | | | |
| Draw Ratio Ratio, Speeds | | | | | | | |
| Warp Draw Ratio (WDR) | 1.62 | 1.54 | 1.34 | 1.34 | 1.34 | 1.44 | 1.65 |
| Take-Up Speed (m/min) | 500 | 500 | 500 | 500 | 500 | 500 | 500 |
| Relax/Overfeed (%) | 0 | 0 | 0 | 0 | 0 | 10 | 10 |
| Effective WDR (EWDR) | 1.62 | 1.54 | 1.34 | 1.34 | 1.34 | 1.30 | 1.49 |
| Temperatures (°C.) | | | | | | | |
| Feed Rolls | 60 | 60 | 60 | 60 | 60 | RT | RT |
| Preheater Plate | 86 | 86 | 86 | 86 | RT | RT | RT |
| Draw Pin | 95 | 95 | 95 | 59 | OFF | OFF | OFF |
| Set Plate | 160 | 170 | 170 | 195 | RT | RT | RT |
| Relax Plate | RT | RT | RT | RT | RT | 195 | 195 |
| YARNS | | | | | | | |
| Shrinkages - AW, 5 mg/d | | | | | | | |
| Boil-Off, $S_1$ (%) | 5.5 | 6.8 | 4.8 | 4.3 | 25.8 | 1.6 | 2.1 |
| Thermal Stability, $S_2$ (%) | 2.6 | 3.2 | 2.0 | 2.0 | (7.2) | 1.0 | 2.2 |
| Net, $S_{12}$ (%) | 8.1 | 10.0 | 6.8 | 6.3 | 18.6 | 2.6 | 4.3 |
| Tension, ST, (g/d) | 0.22 | 0.41 | 0.22 | 0.22 | 0.18 | 0.05 | 0.26 |
| Tensiles - AW | | | | | | | |
| Modulus, M (g/d) | 79.5 | 98.8 | 79.0 | 79.9 | 60.0 | 70.5 | 81.4 |

TABLES II and III-continued

| YARN NO. | II-1 | III-2 | III-1 | III-3 | III-4 | III-5 | III-6 |
|---|---|---|---|---|---|---|---|
| Ten. at 7%, $T_7$ (g/d) | 2.7 | 3.4 | 2.0 | 2.1 | 1.4 | 1.7 | 2.6 |
| Ten. at 20%, $T_{20}$ (g/d) | 4.0 | 4.8 | 3.2 | 2.4 | 2.2 | 3.2 | 4.8 |
| PY Modulus, PYM (g/d) | 14.7 | 16.3 | 13.1 | 14.1 | 8.8 | 15.5 | 22.9 |
| Elongation, $E_B$ (%) | 24.4 | 24.2 | 42.3 | 38.2 | 48.1 | 43.0 | 26.3 |
| Tenacity, T (g/d) | 4.0 | 4.6 | 4.0 | 4.1 | 3.5 | 4.1 | 4.8 |
| Tensiles - ABO | | | | | | | |
| Modulus, M (g/d) | 48.3 | 44.5 | 41.2 | 53.9 | 37.7 | 60.8 | 50.2 |
| Ten. at 7%, $T_7$ (g/d) | 1.5 | 1.7 | 1.3 | 1.5 | 0.8 | 1.5 | 1.9 |
| Ten. at 20%, $T_{20}$ (g/d) | 3.4 | 3.9 | 2.6 | 2.9 | 1.1 | 3.0 | 4.5 |
| PY Modulus, PYM (g/d) | 19.0 | 22.0 | 13.3 | 14.4 | 2.8 | 15.3 | 25.9 |
| Elongation, $E_B$ (%) | 30.7 | 28.8 | 44.3 | 40.0 | 90.6 | 40.2 | 23.2 |
| Tenacity, T (g/d) | 3.7 | 4.1 | 3.5 | 3.7 | 2.6 | 3.7 | 4.3 |
| Tensiles - ADH | | | | | | | |
| Modulus, M (g/d) | 54.5 | 70.1 | 60.9 | 64.9 | 12.5 | 66.7 | 63.5 |
| Ten. at 7%, $T_7$ (g/d) | 1.4 | 1.6 | 1.3 | 1.4 | 0.8 | 1.3 | 1.5 |
| Ten. at 20%, $T_{20}$ (g/d) | 3.4 | 3.9 | 2.7 | 2.8 | 1.0 | 2.8 | 4.3 |
| PY Modulus, PYM (g/d) | 19.9 | 22.8 | 14.2 | 14.3 | 1.8 | 15.1 | 27.3 |
| Elongation, $E_B$ (%) | 31.6 | 32.2 | 47.1 | 43.0 | 112.8 | 47.5 | 28.7 |
| Tenacity, T (g/d) | 3.7 | 4.1 | 3.5 | 3.7 | 2.6 | 3.7 | 4.3 |
| Crystallinity - AW | | | | | | | |
| Density, $\rho$ (g/cm$^3$)* | 1.3807 | 1.3824 | 1.3783 | 1.3838 | 1.3590 | 1.3940 | 1.3842 |
| Crystal Size, CS (Å) | 52 | 58 | 53 | 61 | Small | 55 | 60 |
| Dyeability - AW | | | | | | | |
| Yarn Rel. Disp. Dye Rate (RDDR) | 0.062 | 0.049 | 0.071 | 0.061 | 0.124 | 0.074 | 0.052 |
| Fabric Dye Uptake (K/S) | 5.7 | 5.1 | 8.4 | 7.0 | 9.3 | 8.0 | 5.6 |
| FABRICS | | | | | | | |
| Fabric Type | ← Jersey Warp Knit → | | | | | | |
| Course × Wale, greige | 55 × 35 | 56 × 38 | 60 × 38 | 60 × 36 | 62 × 33 | 62 × 35 | 58 × 36 |
| Course × Wale, finished | 56 × 47 | 56 × 50 | 56 × 50 | 56 × 50 | 67 × 58 | 56 × 50 | 56 × 44 |
| Area Wt. (oz/yd$^2$), greige | 3.40 | 3.41 | 3.85 | 3.84 | 3.80 | 3.78 | 3.54 |
| Area Wt. (oz/yd$^2$), finished | 4.4 | 4.55 | 4.96 | 5.11 | 6.57 | 5.03 | 4.05 |
| ΔWt./Area (%) | 29.4 | 33.4 | 28.8 | 33.1 | 72.9 | 33.1 | 14.4 |
| Mullen Burst (lbs./in.) | 117 | 123 | 113 | 110 | 91 | 99 | 117 |
| Burst Strength $\left(\frac{\text{lbs} \cdot \text{yd}^2}{\text{oz} \cdot \text{in}}\right)$ | 26.6 | 27.0 | 22.8 | 21.5 | 13.9 | 19.7 | 28.9 |
| Dyed Fabric Rating (1 = worst; 5 = no defect) | | | | | | | |
| Long Streaks (LS) | 4 | 4 | 3 | 2 | 1 | 4 | 3 |
| Short Streaks (SS) | 3 | 3 | 2 | 3 | 5 | 4 | 3 |
| Dye Mottle (DM) | 2 | 3 | 3 | 2 | 5 | 2 | 3 |
| Deep Dye Streaks (DDS) | 5 | 5 | 5 | 5 | 1 | 5 | 5 |
| Average Rating (AR) | 3.5 | 3.75 | 3.25 | 3 | 3 | 3.75 | 3.5 |

TABLE IV

| YARN NO. | IV-1 | IV-2 | IV-3 | IV-4 | IV-5 | IV-6 | IV-7 | IV-8 | IV-9 |
|---|---|---|---|---|---|---|---|---|---|
| Draw Ratio | — | RELAX | RELAX | TAUT | TAUT | 1.05 | 1.05 | 1.10 | 1.10 |
| Draw Temperature (°C.) | — | 100 | 180 | 100 | 180 | 95 | 180 | 95 | 180 |
| Wet/Dry | — | WET | DRY | WET | DRY | WET | DRY | WET | DRY |
| Density, $\rho$ (g/cm$^3$)* | 1.3719 | 1.3877 | 1.3936 | 1.3862 | 1.3908 | 1.3756 | 1.3976 | 1.3801 | 1.397 |
| Birefringence ($\Delta_n$) | 0.071 | 0.102 | 0.122 | 0.101 | 0.109 | 0.081 | 0.121 | 0.099 | 0.127 |
| Crystal Size, CS (λ) | 72 | 75 | 72 | 66 | 72 | 68 | 75 | — | — |
| Modulus, M (g/d) | 48.5 | 40.7 | 51.0 | 46.0 | 52.8 | 48.4 | 58.3 | 54.6 | 66.6 |
| Tenacity at 7%, $T_7$ (g/d) | 0.9 | 1.0 | 1.2 | 1.1 | 1.2 | 1.1 | 1.3 | 1.3 | 1.3 |
| Elongation, $E_B$ (%) | 89.1 | 86.9 | 76.5 | 85.2 | 81.2 | 66.7 | 60.2 | 56.1 | 47.8 |
| Tenacity, T (g/d) | 3.0 | 2.9 | 2.9 | 2.9 | 3.0 | 2.9 | 3.0 | 3.0 | 3.0 |
| Shrinkage Tension, ST (g/d) | 0.07 | 0.02 | 0.02 | 0.02 | 0.03 | 0.14 | 0.09 | 0.20 | 0.17 |
| Dye Uptake (K/S) | 17.7 | — | — | 15.6 | 16.3 | 16.7 | 12.2 | 16.8 | 10.7 |

TABLE V

| YARN NO. | V-1 | V-2 | V-3 |
|---|---|---|---|
| Updrawn Denier | 114.6 | 106.7 | 108.0 |
| Filaments - Shape | 34 TRI | 34 RND | 50 TRI |
| $TiO_2$, % | 0.035 | 0.30 | 0.035 |
| Viscosity, ($\eta$) | 0.658 | 0.656 | 0.65 |
| Boil-Off Shrinkage, $S_1$ (%) | 33.4 | 17.6 | 3.4 |
| Modulus, M (g/d) | 27.9 | 34.3 | 49.5 |
| Tenacity at 7% Elong., $T_7$ (g/d) | 0.58 | 0.62 | 0.87 |
| Stress at 7% Elongation, $\sigma_7$ (g/d) | 0.62 | 0.66 | 0.93 |
| Yield Stress, $\sigma_y$ (g/d) | 0.68 | 0.75 | 0.96 |

TABLE V-continued

| YARN NO. | V-1 | V-2 | V-3 |
|---|---|---|---|
| Yield Zone, E''-E' (%) | 21.5 | 18.0 | 6.0 |
| Elongation to Break, $E_B$ (%) | 118.4 | 95.8 | 74.9 |
| Uniform Partial Draw | No | No | Yes |

$\sigma_7 = T_7 \times 1.07$

Stress, $\sigma$ = (load (g)/initial denier) × (1 + Elongation (%)/100)

E' = Elongation to yield point ($\sigma'_y$)

E'' = Elongation to post yield point ($\sigma''_y$), where ($\sigma'_y$ = "$_y$)

TABLE VI

| Yarn No. | VI-1 | VI-2 | VI-3 |
|---|---|---|---|
| Updrawn Denier | 127.2 | 107.0 | 101.4 |
| Filaments - Shape | 34 RND | 34 RND | 50 TRI |
| TiO2, % | 0.30 | 0.30 | 0.035 |
| Boil-Off Shrinkage, S1 (%) | 54.8 | 11.1 | 3.2 |
| Modulus, M (g/d) | 22.0 | 25.1 | 36.6 |
| Ten. at 7% ELong., T7 (g/d) | 0.56 | 0.69 | 0.99 |
| Stress at 7% Elongation, $\sigma 7$ (g/d) | 0.60 | 0.74 | 1.06 |
| Yield Stress, $\sigma y$ (g/d) | 0.65 | 0.85 | 1.09 |

TABLE VI-continued

| Yarn No. | VI-1 | VI-2 | VI-3 |
|---|---|---|---|
| Yield Zone, E''-E' (%) | 46 | 26 | 8 |
| Elong. to Break, EB (%) | 136.2 | 120.7 | 73.3 |
| Uniform Partial Draw | No | No | Yes |

Yarns VI-1 thru VI-3 had a nominal Viscosity [$\eta$] of 0.65.
$\sigma_7$ = T7 × 1.07
Stress, $\sigma$ = [Load (g)/initial denier) × (1 + Elongation (%)/100)]
E' = Elongation to yield point ($\sigma'_y$)
E'' = Elongation to post yield point ($\sigma''_y$), where ($\sigma'_y = \sigma''_y$)

TABLE VII-IX

| Yarn No. | VI-1 | VII-1 | VII-2 | VII-3 | VII-4 | VII-5 | VII-6 |
|---|---|---|---|---|---|---|---|
| Warp Draw Ratio, WDR | 1.00 | 1.39 | 1.48 | 1.57 | 1.69 | 1.82 | 1.97 |
| Residual Draw Ratio, RDR | 2.36 | 1.59 | 1.51 | 1.41 | 1.35 | 1.21 | 1.12 |
| Elongation-to-Break, Eb (%) | 136.2 | 58.9 | 51.1 | 40.8 | 34.5 | 21.2 | 12.3 |
| Rel. Denier Spread, WD/Feed | 1.00 | 3.03 | 2.05 | 1.27 | 1.19 | 1.29 | 1.42 |
| Rel. Uster, WD/Feed | 1.00 | 7.58 | 5.12 | 2.33 | 1.58 | 2.69 | 1.79 |
| Dyed Fabric Ratings (DM) | — | 1 | 1 | 3 | 3 | 4 | 5 |
| Yarn No. | VI-2 | VIII-1 | VIII-2 | VIII-3 | VIII-4 | VIII-5 | VIII-6 |
| Warp Draw Ratio, WDR | 1.00 | 1.22 | 1.30 | 1.39 | 1.49 | 1.60 | 1.73 |
| Residual Draw Ratio, RDR | 2.21 | 1.72 | 1.63 | 1.51 | 1.41 | 1.30 | 1.21 |
| Elongation-to-Break, Eb (%) | 120.7 | 71.7 | 62.6 | 51.4 | 40.8 | 29.9 | 21.4 |
| Rel. Denier Spread, WD/Feed | 1.00 | 2.52 | 1.89 | 0.98 | 0.81 | 1.00 | 0.88 |
| Rel. Uster, WD/Feed | 1.00 | 5.67 | 4.03 | 1.73 | 0.85 | 1.08 | 1.37 |
| Dyed Fabric Ratings (DM) | — | 1 | 1 | 2 | 3 | 4 | 5 |
| Yarn No. | VI-3 | IX-1 | IX-2 | IX-3 | IX-4 | IX-5 | IX-6 |
| Warp Draw Ratio, WDR | 1.00 | 1.05 | 1.12 | 1.19 | 1.28 | 1.38 | 1.49 |
| Residual Draw Ratio, RDR | 1.73 | 1.63 | 1.53 | 1.44 | 1.35 | 1.24 | 1.13 |
| Elongation-to-Break, Eb (%) | 73.3 | 63.5 | 52.9 | 43.9 | 35.1 | 24.4 | 12.5 |
| Rel. Denier Spread, WD/Feed | 1.0 | 0.79 | 0.67 | 0.47 | 0.72 | 0.61 | 0.94 |
| Rel. Uster, WD/Feed | 1.0 | 0.92 | 0.96 | 0.60 | 0.51 | 0.45 | 0.41 |
| Dyed Fabric Ratings (DM) | — | 4 | 4 | 4 | 5 | 5 | 5 |

WARP DRAW SPEED, METERS/MINUTE 600
PRE-HEATER PLATE TEMP., C. 90
DRAW PIN TEMP., C. 100
SET PLATE TEMP., C. 140
POST SET PLATE ROLL TEMP., C. 55
RELAXATION, % 0

TABLE X-XII

| Yarn No. | VI-1 | X-1 | X-2 | X-3 | X-4 | X-5 | X-6 |
|---|---|---|---|---|---|---|---|
| Warp Draw Ratio, WDR | 1.00 | 1.39 | 1.48 | 1.57 | 1.69 | 1.82 | 1.97 |
| Residual Draw Ratio, RDR | 2.36 | 1.56 | 1.52 | 1.44 | 1.31 | 1.22 | 1.14 |
| Elongation-to Break, Eb (%) | 136.2 | 55.5 | 51.6 | 43.9 | 30.8 | 21.7 | 14.0 |
| Rel. Denier Spread, WD/Feed | 1.00 | 8.89 | 8.13 | 1.12 | 0.86 | 0.92 | 1.29 |
| Rel. Uster, WD/Feed | 1.00 | 8.57 | 5.40 | 1.26 | 1.05 | 1.12 | 1.64 |
| Dyed Fabric Rations (DM) | — | 1 | 1 | 1 | 3 | 4 | 4 |
| Yarn No. | VI-2 | XI-1 | XI-2 | XI-3 | XI-4 | XI-5 | XI-6 |
| Warp Draw Ratio, WDR | 1.00 | 1.22 | 1.30 | 1.39 | 1.49 | 1.60 | 1.73 |
| Residual Draw Ratio, RDR | 2.21 | 1.69 | 1.60 | 1.48 | 1.37 | 1.28 | 1.17 |
| Elongation-to Break, Eb (%) | 120.1 | 69.2 | 60.1 | 47.6 | 36.8 | 27.9 | 17.5 |
| Rel. Denier Spread, WD/Feed | 1.00 | 6.28 | 4.94 | 0.91 | 0.84 | 0.69 | 0.83 |
| Rel. Uster, WD/Feed | 1.00 | 4.30 | 3.00 | 0.82 | 0.75 | 0.67 | 0.75 |
| Dyed Fabric Rations (DM) | — | 1 | 1 | 1 | 2 | 3 | 4 |
| Yarn No. | VI-3 | XII-1 | XII-2 | XII-3 | XII-4 | XII-5 | XII-6 |
| Warp Draw Ratio, WDR | 1.00 | 1.05 | 1.12 | 1.19 | 1.28 | 1.38 | 1.49 |
| Residual Draw Ratio, RDR | 1.73 | 1.65 | 1.52 | 1.45 | 1.33 | 1.23 | 1.13 |
| Elongation-to Break, Eb (%) | 73.3 | 65.1 | 52.1 | 45.2 | 32.9 | 23.2 | 13.0 |
| Rel. Denier Spread, WD/Feed | 1.0 | 0.96 | 1.14 | 0.83 | 1.27 | 0.86 | 0.93 |
| Rel. Uster, WD/Feed | 1.0 | 0.54 | 0.64 | 0.52 | 0.60 | 0.53 | 0.50 |
| Dyed Fabric Rations (DM) | — | 4 | 4 | 4 | 5 | 5 | 5 |

WARP DRAW SPEED, METERS/MINUTE 600
PRE-HEATER PLATE TEMP., C. RT
DRAW PIN TEMP., C. RT
SET PLATE TEMP., C. 180
POST SET PLATE ROLL TEMP., C. RT
RELAXATION, % 0%

TABLE XIII-XV

| DRAW RATIO, WDR | 1.1 | 1.2 | 1.3 | 1.4 | 1.5 | 1.6 | 1.7 | 1.8 | 1.9 |
|---|---|---|---|---|---|---|---|---|---|
| Feed Yarn No. VI-1 | | | | | | | | | |
| Drawn Yarn No. | | XIII-1 | XIII-2 | XIII-3 | XIII-4 | XIII-5 | XIII-6 | XIII-7 | XIII-8 |

TABLE XIII-XV-continued

| DRAW RATIO, WDR | 1.1 | 1.2 | 1.3 | 1.4 | 1.5 | 1.6 | 1.7 | 1.8 | 1.9 |
|---|---|---|---|---|---|---|---|---|---|
| Residual Draw Ratio, RDR | — | 1.89 | 1.75 | 1.62 | 1.51 | 1.42 | 1.34 | 1.26 | 1.19 |
| Draw Tension, % CV (Draw Temp., C.) | | | | | | | | | |
| −19 C. | — | 2.8 | 2.1 | 3.1 | 4.2 | 5.7 | 2.9 | 3.8 | 4.2 |
| −79 C. | — | 4.8 | 4.3 | 3.2 | 4.2 | 4.6 | 3.4 | 2.1 | 4.5 |
| −100 C. | — | 5.1 | 4.2 | 4.0 | 4.4 | 4.7 | 3.7 | 2.0 | 2.2 |
| −122 C. | — | 4.3 | 4.8 | 5.2 | 4.9 | 4.0 | 2.6 | 1.7 | 2.3 |
| −174 C. | — | 4.1 | 3.2 | 5.3 | 4.6 | 4.4 | 3.7 | 2.6 | 2.1 |
| −224 C. | — | 5.1 | 4.8 | 3.8 | 4.9 | 4.3 | 3.9 | 3.2 | 2.3 |
| Feed Yarn No. VI-2 | | | | | | | | | |
| Drawn Yarn No. | XIV-1 | XIV-2 | XIV-3 | XIV-4 | XIV-5 | XIV-6 | XIV-7 | XIV-8 | |
| Residual Draw Ratio, RDR | 2.01 | 1.85 | 1.70 | 1.58 | 1.47 | 1.38 | 1.30 | 1.23 | |
| Draw Tension, % CV (Draw Temp., C.) | | | | | | | | | |
| −19 C. | 2.5 | 1.9 | 2.5 | 3.4 | 3.0 | 2.9 | 3.1 | 3.6 | |
| −79 C. | 3.2 | 3.6 | 3.2 | 2.7 | 2.0 | 1.5 | 1.4 | 1.8 | |
| −100 C. | 2.7 | 3.4 | 3.8 | 2.1 | 2.1 | 1.4 | 1.0 | 1.5 | |
| −122 C. | 3.1 | 3.0 | 3.5 | 2.5 | 2.1 | 1.8 | 1.2 | — | |
| −174 C. | 4.5 | 5.9 | 3.1 | 3.1 | 2.7 | 2.2 | 2.0 | — | |
| −224 C. | 4.0 | 4.5 | 4.1 | 3.1 | 2.5 | 2.0 | 3.4 | — | |
| Feed Yarn No. VI-3 | | | | | | | | | |
| Drawn Yarn No. | XV-1 | XV-2 | XV-3 | XV-4 | XV-5 | | | | |
| Residual Draw Ratio, RDR | 1.57 | 1.44 | 1.33 | 1.24 | 1.15 | | | | |
| Draw Tension, % CV (Draw Temp., C.) | | | | | | | | | |
| −19 C. | 1.9 | 1.2 | 1.5 | 1.7 | 1.7 | | | | |
| −79 C. | 3.2 | 1.8 | 0.9 | 0.8 | 0.9 | | | | |
| −100 C. | 2.3 | 1.6 | 1.2 | 1.0 | 0.9 | | | | |
| −122 C. | 2.0 | 1.8 | 1.3 | 1.1 | 0.9 | | | | |
| −174 C. | 2.6 | 2.1 | 1.4 | 1.1 | 0.9 | | | | |
| −224 C. | 3.7 | 2.4 | 1.6 | 1.4 | 1.0 | | | | |

MODEL 4000 EXTENSOTRON (TM) - MICRO SENSORS INC. (New Englander Industrial Park, Holliston, Mass. 01746)
DRAW SPEED 25 METERS/MINUTE
DRAW ZONE 1 METER NONCONTACT HOT TUBE
SAMPLE LENGTH 50 METERS
TENSIONOMETER 1000 GRAM HEAD CALIBRATED TO 200 GRAMS
% CV DRAW TENSION 500 DATA POINTS
RESIDUAL DRAW RATIO, RDR = [1 + ELONGATION (%)/1000%]feed/MACHINE DRAW RATIO

TABLE XVI

| EX. XVI-# | 1 | 2 | 3 | 4 |
|---|---|---|---|---|
| FEED YARN ID. | A | B | C | D |
| POLYMER | N66 | N66 | 66 | N6/66 |
| POLYMER RV | 50 | 50 | 65 | 65 |
| SPIN SPEED, MPM | 3909 | 3954 | 5300 | 5300 |
| YARN DENIER | 55 | 52 | 50.5 | 50 |
| DPF | 3.23 | 3.06 | 3.84 | 3.84 |
| CROSS-SECTION | TRI | RND | RND | RND |
| $E_b$, % | 85 | 78 | 73.5 | 76.1 |

TABLE XVIIA

| EX. XVIIA-# | 1 | 2 | 3 | 4 | 5 | 6 |
|---|---|---|---|---|---|---|
| DRAW RATIO | 1.316 | 1.316 | 1.447 | 1.447 | 1.608 | 1.608 |
| HTR TEMP., °C. | 130 | 160 | 130 | OFF | OFF | 130 |
| RELAX ($T_r$), °C. | 118 | 143 | 118 | 22 | 22 | 118 |
| DENIER | 43.8 | 43.7 | 40.0 | 40.2 | 36.1 | 35.8 |
| $E_b$, % | 53.1 | 51.9 | 39.8 | 43.6 | 30.5 | 22.8 |
| MOD., GPD | 15.2 | 16.2 | 17.9 | 29.2 | 23.9 | 47.0 |
| $S_1$, % | 6.1 | 6.2 | 7.4 | 6.6 | 7.3 | 7.6 |
| DYE RATING | + | + | + | + | + | − |

TABLE XVIIB

| EX. XVIIB-# | 1 | 2 | 3 | 4 | 5 | 6 | 7 | 8 | 9 | 10 | 11 |
|---|---|---|---|---|---|---|---|---|---|---|---|
| DRAW RATIO | 1.15 | 1.15 | 1.30 | 1.30 | 1.30 | 1.45 | 1.45 | 1.45 | 1.45 | 1.60 | 1.60 |
| HTR TEMP., °C. | 160 | OFF | 160 | 130 | OFF | 160 | 130 | 100 | OFF | 160 | OFF |
| RELAX ($T_r$), °C. | 143 | 22 | 143 | 118 | 22 | 118 | 118 | 94 | 22 | 143 | 22 |
| DENIER | 49 | 49.5 | 44 | 43.5 | 44.5 | 40 | 39 | 39.5 | 40 | 35.5 | 35.5 |
| $E_b$, % | 64 | 71 | 39 | 44 | 45 | 27 | 34 | 38.5 | 30 | 23 | 22 |
| $S_1$, % | 4.0 | NA | 6.6 | 5.9 | 7.0 | 7.3 | 6.2 | 6.7 | 8.3 | 6.9 | 6.6 |
| DYE RATING | + | + | − | + | + | − | − | + | + | − | − |

TABLE XVIIC

| EX. XVIIC-# | 1 | 2 | 3 | 4 | 5 | 6 | 7 | 8 |
|---|---|---|---|---|---|---|---|---|
| DRAW RATIO | 1.15 | 1.15 | 1.30 | 1.30 | 1.35 | 1.35 | 1.45 | 1.45 |
| HRT TEMP., °C. | 160 | OFF | 160 | OFF | 160 | OFF | 160 | OFF |
| RELAX ($T_R$), °C. | 143 | 22 | 143 | 22 | 143 | 22 | 143 | 22 |
| DENIER | 46 | 46.5 | 41.1 | 41.9 | 40 | 40.2 | 36.8 | 37.2 |

TABLE XVIIC-continued

| EX. XVIIC-# | 1 | 2 | 3 | 4 | 5 | 6 | 7 | 8 |
|---|---|---|---|---|---|---|---|---|
| $E_b$, % | 58.9 | 47 | 39.1 | 41.6 | 36 | 41.2 | 28.3 | 29.5 |
| MOD., GPD | 19 | 20.9 | 25.3 | 22.8 | 26 | 23.4 | 28.6 | 30.7 |
| $S_1$, % | 4.9 | 5.9 | 6.7 | 5.9 | 6.9 | 6.4 | 7.2 | 6.9 |
| DYE RATING | + | + | + | + | − | + | + | + |

TABLE XVIID

| EX. XVIID-# | 1 | 2 | 3 | 4 | 5 | 6 | 7 |
|---|---|---|---|---|---|---|---|
| DRAW RATIO | 1.15 | 1.30 | 1.30 | 1.30 | 1.45 | 1.45 | 1.45 |
| HTR TEMP., °C. | 160 | OFF | 130 | 160 | OFF | 130 | 160 |
| RELAX ($T_r$), °C. | 143 | 22 | 118 | 143 | 22 | 118 | 143 |
| DENIER | 44.7 | 40.5 | 39.5 | 39.8 | 36.5 | 35.6 | 35.4 |
| $E_b$, % | 60.3 | 49.8 | 41.7 | 43.2 | 36.4 | 33.2 | 30.5 |
| MOD., GPD | 18.4 | 21.8 | 21.8 | 23.5 | 21.3 | 29.2 | 26.6 |
| $S_1$, % | 5.9 | 6.9 | 7.5 | 7.6 | 8.1 | 8.6 | 8.3 |
| DYE RATING | + | + | +/− | − | + | + | − |

We claim:

1. A process for preparing a mixed filament textile yarn comprised of drawn polyester and nylon filaments, wherein spin-oriented polyester filaments and nylon feed filaments are partially drawn to uniform filaments by hot-drawing or by cold-drawing, with or without heat setting, and the polyester and nylon filaments are combined to form a mixed filament yarn before or after said drawing and/or heat setting treatments; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$−282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

2. A process for preparing a mixed filament textile yarn comprised of drawn polyester and nylon filaments, wherein spin-oriented polyester filaments and nylon feed filaments are cold drawn to uniform filaments with or without heat setting, and the polyester and nylon filaments are combined to form a mixed filament yarn before or after said drawing and/or heat setting treatments; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$−282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

3. A process for preparing a mixed filament textile yarn comprised of drawn polyester and nylon filaments, wherein spin-oriented polyester filaments and nylon feed filaments are drawn to uniform filaments by hot-drawing without heat setting, and the polyester and nylon filaments are combined to form a mixed filament yarn before or after said drawing; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$−282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

4. A process for preparing a mixed filament textile yarn comprised of drawn polyester and nylon filaments, wherein spin-oriented polyester filaments and nylon feed filaments are drawn to uniform filaments by hot-drawing with post heat treatment to reduce shrinkage, at such a draw ratio to provide said uniform filaments with elongation-to-break at least about 30%, and the polyester and nylon filaments are combined to form a mixed filament yarn before or after said drawing and/or post heat treatments; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$−282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

5. A process for preparing a mixed filament textile yarn comprised of polyester and nylon filaments, wherein spin-oriented polyester filaments and nylon feed filaments are heat treated without drawing, and the polyester and nylon filaments are combined to form a mixed filament yarn before or after said heat treatment; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$-282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

6. A process for preparing a post-bulkable mixed filament yarn, wherein spin-oriented polyester filaments and nylon feed filaments are drawn to uniform drawn filaments by hot-drawing or by cold-drawing, and then said drawn filaments are post treated at temperatures ($T_R$), selected to preferentially reduce the shrinkage of the drawn polyester filaments such that boil-off shrinkages ($S_1$) of the resulting drawn polyester filaments and drawn nylon filaments differ from each other by at least about 5%; and the polyester and nylon filaments are combined to form a mixed filament yarn before or after said drawing and/or heat treatment; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$-282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

7. A process according to any one of claims 1 to 6, wherein said spin-oriented polyester filaments and said nylon feed filaments are provided in the form of a mixed filament spin-oriented co-spun feed yarn, and wherein the elongation-to-break (Eb) of said spin-oriented polyester and of said nylon feed filaments differ from each other by less than about 5%, and wherein any post heat treatment is carried out at a temperature ($T_R$ in degrees C.) less than about the following expression:

$$T_R < (1000/[4.95 - 1.75(RDR)_{D,N}] - 273),$$

where $(RDR)_{D,N}$ is the calculated residual draw ratio of the drawn nylon filaments, and is at least about 1.2.

8. A process according to any one of claims 1 to 6, wherein said spin-oriented polyester and nylon feed filaments are of elongations ($E_B$) differing from each other by less than about 5%, and are provided in the form of a plurality of mixed filament spin-oriented co-spun feed yarns, and said spin-oriented feed yarns are drawn in the form of a weftless warp sheet suitable for knitting, weaving, or winding onto a beam, and any post heat treatment is carried out at a temperature ($T_R$ in degrees C.) less than about the following expression:

$$T_R < (1000/[4.95 - 1.75(RDR)_{D,N}] - 273),$$

where $(RDR)_{D,N}$ is the calculated residual draw ratio of the drawn nylon filaments, and is at least about 1.2.

9. A process according to any one of claims 1 to 6, wherein said spin-oriented polyester and nylon feed filaments are of elongations ($E_B$) differing from each other by less than about 5%, and are provided in the form of a mixed filament spin-oriented co-spun feed yarn, and wherein any post heat treatment is carried out at a temperature ($T_R$ in degrees C.) less than about the following expression:

$$T_R < (1000/[4.95 - 1.75(RDR)_{D,N}] - 273),$$

where $(RDR)_{D,N}$ is the calculated residual draw ratio of the drawn nylon filaments, and is at least about 1.2, and wherein the resulting drawn mixed filament yarn is air-jet textured to provide a mixed filament textured yarn.

10. A process for preparing a mixed filament textured yarn comprised of polyester filaments and nylon filaments, wherein spin-oriented polyester filaments and nylon feed filaments are simultaneously partially drawn and false-twist textured to uniform filaments by hot-drawing with or without heat setting, and the polyester and nylon filaments are combined to form a mixed filament yarn before or after said drawing and/or heat setting treatments; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about i0%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$-282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

11. A process for preparing a mixed filament textured yarn comprised of polyester filaments and nylon filaments, wherein spin-oriented polyester filaments and nylon feed filaments are sequentially partially drawn to uniform filaments by hot-drawing or by cold-drawing, then false-twist textured with heat setting, and the polyester and nylon filaments are combined to form a mixed filament yarn before or after said drawing and/or texturing treatments; wherein said spin-oriented polyester filaments are characterized by an intrinsic viscosity [$\eta$] about 0.56 to about 0.68, elongation-to-break ($E_B$) about 60 to about 90%, boil-off shrinkage ($S_1$) less than about 10%, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$-282.5) Angstroms; and wherein said nylon feed filaments are characterized by relative viscosity (RV) about 40 to about 80, elongation-to-break ($E_B$) about 60 to about 90%, boil-off shrinkage ($S_1$) less than about 10%, and dimensional stability as measured by a ($\Delta L_{135\text{-}40\ C}$)-value less than 0.

12. A process for preparing a mixed filament yarn, of polyester filaments and nylon filaments, of elongation ($E_B$) about 60% to about 90% and boil-off shrinkage ($S_1$) less than about 10%, comprising co-spinning, attenuating, quenching, and winding said polyester and nylon filaments at a withdrawal speed (V) of about 3.5 km/min to about 6.5 km/min, such that the relative viscosity (RV) of said nylon filaments is between about 40 and 80 and less than about the expression: [13.3V -(6.5-X)], wherein X is the weight percent of any copolyamide, with suitable dimensional stability, as measured by a ($\Delta L_{135\text{-}45\ C}$)-value less than about 0; and wherein said polyester filments are of intrinsic viscosity [$\eta$] about 0.56 to about 0.68, thermal stability as measured by a ($S_2$)-value less than about +1%, net shrinkage ($S_{12}$) less than about 8%, maximum shrinkage tension (ST) less than about 0.3 gpd, density ($\rho$) about 1.35 to about 1.39 g/cm$^3$, and crystal size (CS) about 55 to about 90 Angstroms and also at least about (250$\rho$-282.5) Angstroms.

13. A process according to claim 12 that is a coupled spin/draw process wherein, prior to winding, said polyester filaments and nylon filaments are partially drawn to provide uniform drawn polyester and drawn nylon filaments, by hot-drawing or by cold-drawing to drawn elongations ($E_B$) between about 30% and about 90% and wherein these drawn elongations ($E_B$) differ from each other by less than about 5%, with or without heat setting to provide a boil-off shrinkage less than about 10% and drawn nylon filaments of dimensional stability as given by a ($\Delta L_{135\text{-}40\ C}$)-value less than 0; and wherein said drawn polyester filaments are of tenacity at 7% elongation ($T_7$) at least about 1 gram/denier, post yield modulus (PYM, g/d) such that its square root ($\sqrt{PYM}$) is about 2.5 to about 5, thermal stability as shown by an $S_2$-value less than about +2%, net shrinkage ($S_{12}$) less than about 8%, maximum shrinkage tension (ST) less than about 0.5 g/d, density ($\rho$) about 1.355 to about 1.415 grams/cubic centimeter, and of crystal size (CS) about 60 to about 90 Angstroms and also at least about (250$\rho$-282.5) Angstroms.

14. A process according to claim 12 that is a coupled spin/draw process, wherein prior to winding, said polyester and nylon filaments are cold drawn to provide uniform drawn polyester and drawn nylon filaments, of drawn elongations ($E_B$) about 20% to about 90% and said drawn elongations ($E_B$) differ from each other by less than about 5%, with or without heat setting to provide boil-off shrinkage ($S_1$) less than about 10% and drawn nylon filaments of dimensional stability as given by a ($\Delta L_{135\text{-}40\ C}$)-value less than 0; and wherein said drawn polyester filaments are of tenacity at 7% elongation ($T_7$) at least about 1 gram/denier, post yield modulus (PYM, g/d) such that its square root ($\sqrt{PYM}$) is about 2.5 to about 5, thermal stability as shown by an $S_2$-value less than about +2%, net shrinkage ($S_{12}$) less than about 8%, maximum shrinkage tension (ST) less than about 0.5 g/d, density ($\rho$) about 1.355 to about 1.415 grams/cubic centimeter, and of crystal size (CS) about 60 to about 90 Angstroms and also at least about (250$\rho$-282.5) Angstroms.

15. A process according to claim 14, wherein any said heat setting treatment is carried out at a temperature ($T_R$, in degrees C.) less than about the following expression:

$$T_R < (1000/[4.95 - 1.75(RDR)_{D,N}] - 273),$$

where $(RDR)_{D,N}$ is the calculated residual draw ratio of the drawn nylon filaments, and is at least about 1.2.

16. A process according to claim 13, wherein any said heat setting treatment is carried out at a temperature ($T_R$ in degrees C.) less than about the following expression:

$$T_R < (1000/[4.95 - 1.75(RDR)_{D,N}] - 273),$$

where $(RDR_{D,N}$ is the calculated residual draw ration of the drawn nylon filaments, and is at least about 1.2.

* * * * *